US006952546B2

(12) United States Patent
Yoshikawa

(10) Patent No.: US 6,952,546 B2
(45) Date of Patent: Oct. 4, 2005

(54) IMAGE FORMING APPARATUS ADOPTING IMAGE BEARING MEMBER CLEANER-LESS SYSTEM

(75) Inventor: Tadanobu Yoshikawa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/668,308

(22) Filed: Sep. 24, 2003

(65) Prior Publication Data

US 2004/0131385 A1 Jul. 8, 2004

(30) Foreign Application Priority Data

Sep. 27, 2002 (JP) ..... 2002-282757

(51) Int. Cl.[7] ..... G03G 21/00; G03G 15/30
(52) U.S. Cl. ..... 399/129; 399/149
(58) Field of Search ..... 399/50, 71, 128, 399/129, 149, 150, 168, 174, 175, 176, 343, 353, 354

(56) References Cited

U.S. PATENT DOCUMENTS 5,294,961 A * 3/1994 Ohtaka et al. ..... 399/150
6,006,055 A * 12/1999 Furuya ..... 399/149
6,026,259 A * 2/2000 Yamaki et al. ..... 399/128
6,215,967 B1 * 4/2001 Takeda et al. ..... 399/149 X
6,345,162 B1 * 2/2002 Ozawa et al. ..... 399/149 X
6,421,512 B2 7/2002 Watanabe et al. ..... 399/149
2002/0057925 A1 * 5/2002 Watanabe et al. ..... 399/129
2002/0127025 A1 * 9/2002 Sasai ..... 399/149 X
2003/0147659 A1 8/2003 Yoshikawa et al. ..... 399/44

FOREIGN PATENT DOCUMENTS

JP 2002/144569 5/2002
JP 2002-144584 5/2002

* cited by examiner

*Primary Examiner*—Sandra L. Brase
(74) *Attorney, Agent, or Firm*—Fitzpatrick, Cella, Harper & Scinto

(57) ABSTRACT

A image forming apparatus includes an image bearing member to be moved rotationally, charging means for electrically charging the image bearing member and toner remaining on the image bearing member, electrostatic latent image forming means for forming an electrostatic latent image on the image bearing member charged by the charging means, developing means for visualizing the electrostatic latent image while recovering the toner remaining on the image bearing member, toner charging means which is disposed upstream from the charging means in a rotational direction of the image bearing member and is to be supplied with a voltage of a polarity identical to that of a voltage to be applied to the charging means to electrically charge the toner remaining on the image bearing member, recording means for recording an operation history of the image forming apparatus, and control means for controlling the voltage to be supplied to the toner charging means on the basis of the operation history of the image forming apparatus recorded by the recording means.

19 Claims, 12 Drawing Sheets

IMAGE FORMING APPARATUS ADOPTING IMAGE BEARING MEMBER CLEANER-LESS SYSTEM

FIELD OF THE INVENTION AND RELATED ART

The present invention relates to an image forming apparatus, such a a copying machine, using an electrophotographic process or an electrostatic recording process, particularly to a so-called cleaner-less image forming apparatus wherein toner remaining on an image bearing member is recovered into a developing device to be reutilized.

In recent years, an image forming apparatus such as a copying machine has advanced along the path of downsizing but there has been a limit on the downsizing only by downsizing the respective means for performing processes of charging, exposing, developing, transferring and cleaning.

Further, in the image forming apparatus of the type wherein the toner image formed on the image bearing member is transferred onto a recording material or the like, the toner remaining on the image bearing member is recovered by the cleaner, thus resulting in waste toner. However, this is not desirable environmentally.

For this reason, the so-called cleaner-less system such that the toner remaining on the image bearing member is electrically charged by a charger for charging the image bearing member and recovered by the developing means to be reutilized, has been proposed.

In such a cleaner-less type image forming apparatus, e.g., the residual toner on the image bearing member is also charged at the same time when the image bearing member is charged by the charger supplied with a DC voltage. Such a image forming apparatus includes, in addition to a charger for charging an image bearing member and a residual toner thereon, another charger for charging, other than the charger, disposed upstream from the charger in a rotational (bearing) direction of the image bearing member. To another charger, a bias voltage of a polarity identical to that of a bias voltage applied to the charger for charging the image bearing member and the residual toner thereon is applied. The electric charges of the residual toner on the image bearing member immediately after the transfer process have a positive polarity and a negative polarity. For this reason, the charge polarity of the transfer residual toner is uniformized in advance to the polarity identical to that of the bias voltage applied to the charger for charging the image bearing member and the transfer residual toner on the image bearing member. Under the action of an electrically repulsive force between the electric charges of the transfer residual toner and the bias voltage applied to the charger for charging the image bearing member and the transfer residual toner on the image bearing member, it is possible to prevent adhesion of the transfer residual toner onto the charger for charging the image bearing member and the transfer residual toner on the image bearing member. As a result, stabilization of chargeability of the charger for charging the image bearing member and the transfer residual toner on the image bearing member is ensured. The above transfer residual toner to which the electric charges are imparted is recovered into the developing means as described above.

Further, from the viewpoint of uniform chargeability, it is preferable to apply an oscillating voltage comprising a DC voltage superposed or biased with an AC voltage to the contact charging member.

However, in the case where such a voltage superposed with the AC voltage is applied, the toner is charge-removed by the AC voltage to reduce the electrostatic repulsive force, thus causing the toner adhesion to the contact charging member.

In view of this problem, U.S. Pat. No. 6,421,512 has disclosed an image forming apparatus wherein toner which has been charge-removed to have uniform triboelectric charge by a first charge removing brush is strongly charged to a polarity identical to the charge polarity, thus being provided with substantially uniform triboelectric charge to prevent the toner adhesion to the contact charging member of the AC charging scheme.

However, in the case where the bias voltage applied to the charger for charging the image bearing member and the transfer residual toner is changed by using the bias voltage of DC voltage superposed with AC voltage, when the applied voltage is low, the resultant electrostatic repulsive force of the transfer residual toner with the charger for charging the image bearing member and the transfer residual toner becomes small. Particularly, when the toner adheres to another charger in long-term use of the image forming apparatus and lower the chargeability of another charger, the electrostatic repulsive force created between the transfer residual toner and the charger for charging the image bearing member and the transfer residual toner is further lowered. By the lowering in such an electrical potential repulsive force, the transfer residual toner adheres to the charger for charging the image bearing member and the transfer residual toner to lower the charging performance of the charger for charging the image bearing member and the transfer residual toner. As a result, it becomes difficult to impart an appropriate charge, for recovering the toner into the developing means, to the transfer residual toner. For this reason, such a problem that toner attaches to non-image (forming) portion in an image area has arisen.

SUMMARY OF THE INVENTION

An object of the present invention is to prevent an occurrence of toner adhesion to a non-image portion in an image area in a cleaner-less type image forming apparatus including not only a charging means for charging an image bearing member and a residual toner but also a charger other than the charging means even when the image forming apparatus is used for a long period of time.

Another object of the present invention is to provide such an image forming apparatus.

According to the present invention is to provide an image forming apparatus, comprising:

an image bearing member to be moved rotationally, charging means for electrically charging the image bearing member and toner remaining on the image bearing member, electrostatic latent image forming means for forming an electrostatic latent image on the image bearing member charged by the charging means, developing means for visualizing the electrostatic latent image while recovering the toner remaining on the image bearing member, toner charging means which is disposed upstream from the charging means in a rotational direction of the image bearing member and is to be supplied with a voltage of a polarity identical to that of a voltage to be applied to the charging means to electrically charge the toner remaining on the image bearing member, recording means for recording an operation history of the image forming apparatus, and control means for controlling the voltage to be supplied to the toner charging means on the basis of the operation history of the image forming apparatus recorded by the recording means.

DETAILED DESCRIPTION OF THE PREFERRED EMBODIMENTS

<Embodiment 1>

First, the overall structure of the image forming apparatus according to the present invention will be described with reference to FIG. 1.

Figure 1:
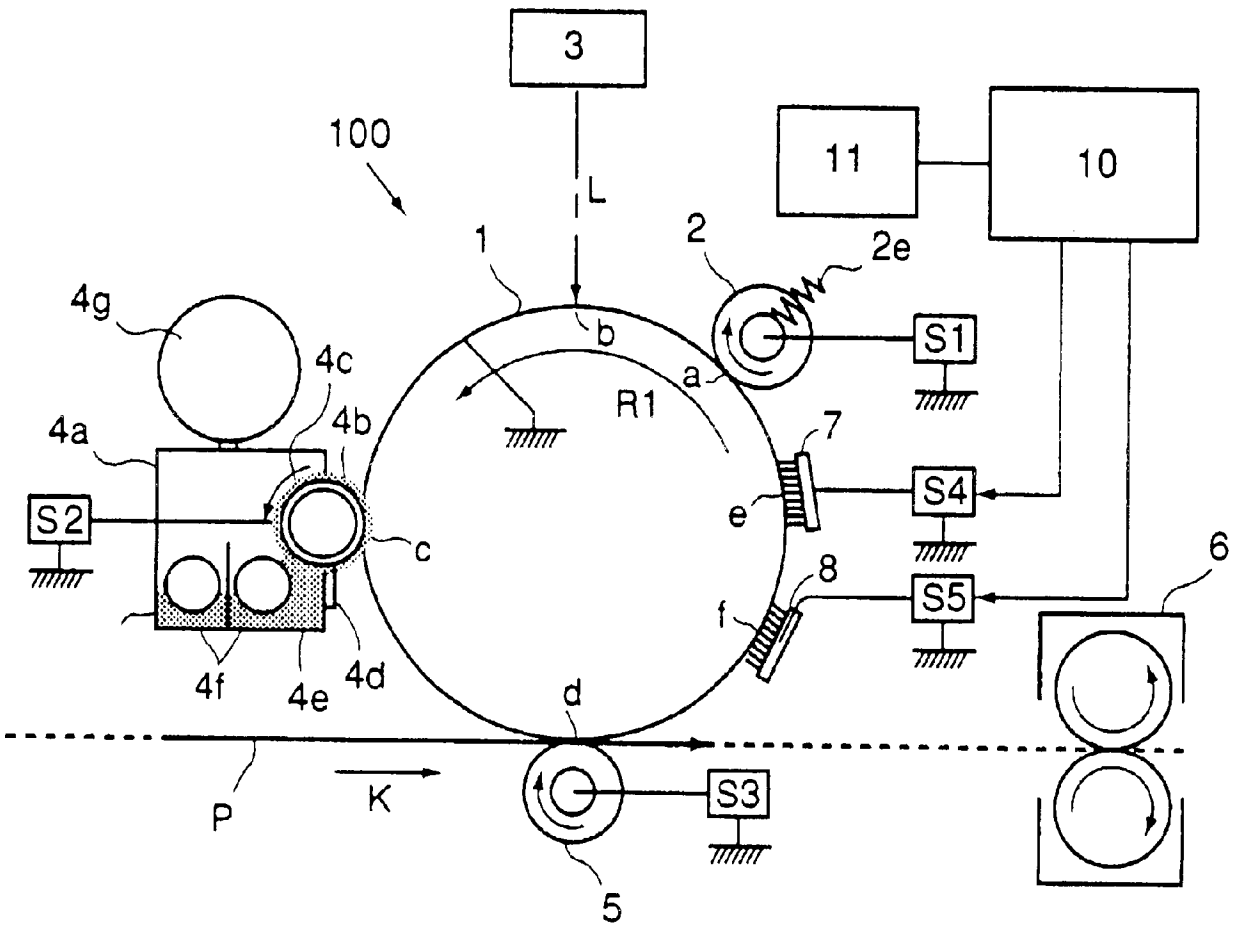
FIG. 1 is a schematic sectional view of an embodiment of the image forming apparatus according to the present invention, for illustrating the general structure thereof.

An image forming apparatus of this embodiment of the present invention, as shown in FIG. 1, includes a photosensitive drum image bearing member 1. Around the photosensitive drum 1, a charge roller (charging means) 2 for electrically charging the surface of the image bearing member and toner remaining on the image bearing member, an exposure apparatus (electrostatic latent image forming means) 3 for forming an electrostatic latent image on the image bearing member on the basis of image information, a developing apparatus (developing means) 4 for bearing on a developing sleeve a developer being a mixture of toner with a carrier and forming a toner image by visualizing the electrostatic latent image on the image bearing member while recovering toner remaining on the image bearing member, a transfer roller (transfer means) 5 for transferring the toner image on the image bearing member to a recording material P, an electrostatic latent image erase means 8 for erasing the electrostatic latent image on the image bearing member after the transfer process to substantially uniformize a surface potential of the image bearing member, and a toner charging means 7 for electrically charging the toner remaining on the image bearing member are disposed in this order along a rotational direction of the photosensitive drum (a direction of an arrow R1). Further, a fixing apparatus (fixing means) 6 is disposed downstream from the transfer roller 5 along a conveyance direction (an arrow K direction) of the recording material P. Further, the image forming apparatus includes a recording means 11 for recording an operation history of the image forming apparatus, and a control means 10 for changing and controlling a bias voltage to be applied to the toner charging means 7 and the electrostatic latent image erase means 8 on the basis of the operation history recorded by the recording means.

To the charge roller 2, a negative(-polarity) bias voltage is applied. The image bearing member is electrically charged to a potential suitable for formation of the electrostatic latent image. At the same time, the residual toner is electrically charged to have an amount of electric charge suitable for recovery into the developing means 4.

The toner charging means 7 uniformized the charge polarity of the residual toner particles of positive and negative polarities in mixture to the negative polarity being the polarity of a voltage applied to the charger 2 and also imparts to the residual toner a sufficient amount of electric charge for,preventing adhesion of the residual toner (particles) to the charger 2 caused by the electrical repulsive force.

The electrostatic latent image erase means 8 erases the electrostatic latent image in the photosensitive drum 1 after the transfer process and uniformize the surface potential of the photosensitive drum 1. To the electrostatic latent image erase means 8, a bias voltage of a polarity opposite from that of the electrostatic latent image formed on the electrostatic latent image forming means 3. In this embodiment, the positive bias voltage is applied. By the uniformization of the surface potential, the electric charge is uniformly imparted from the toner charging means 7 to the transfer residual toner, thus resulting in efficient charging.

The recording means records the operation history of the image forming apparatus.

By the use of the image forming apparatus for a long period of time, the toner adheres to the toner charging means 7 and the electrostatic latent image erase means 8, thus increasing an electrical resistance of these means. Accordingly, the chargeabilities (charging performances) of the toner charging means 7 and the electrostatic latent image erase means 8 are lowered.

For this reason, on the basis of the operation history of the image forming apparatus recorded by the recording means 11, the control means 10 controls the bias voltages applied to the toner charging means 7 and the electrostatic latent image erase means 8 to compensate for the lowering in chargeability to prevent an occurrence of toner adhesion in a non-image area. In this embodiment, with a longer period of the use of the image forming apparatus, the bias voltage values applied to the toner charging means 7 and the electrostatic latent image erase means 8 are made larger on the charge polarity side.

When the bias voltage applied to the toner charging means 7 at an initial stage such that the toner has not adhered to the toner charging means 7 is increased on the charge polarity side, the amount of electric charge imparted to the transfer residual toner becomes very large, so that the charging means 2 fails to charge the transfer residual toner to an electric charge suitable for recovery by the developing means 4.

Further, when the bias voltage applied to the electrostatic latent image erase means 8 at an initial stage such that the toner has pot adhered to the electrostatic latent image erase means 8 is increased on the charge polarity side, the photosensitive drum 1 is strongly charged to a polarity opposite from the electrostatic latent image formed thereon. As a result, the charging means 2 fails to charge the photosensitive drum 1 to a potential suitable for electrostatic latent image formation.

Accordingly, it is necessary to change and control the bias voltages applied to the toner charging means 7 and the electrostatic latent image erase means 8 by the control means 10 on the basis of the operation history recorded by the recording means 11.

Hereinafter, structures and structural members of the image forming apparatuses in accordance with this embodiment will be described in more detail.

FIG. 1 is a schematic drawing of an example of an image forming apparatus in accordance with the present invention, for showing the general structure thereof. This embodiment of an image forming apparatus 100 is an electrophotographic laser beam printer employing a contact charging method, a two component contact developing method, and a cleanerless system.

(1) General Structure of Printer

First, the general structure of the printer 100 of this embodiment will be described with reference to FIG. 1.

(a) Image Bearing Member

Designated by a reference numeral 1 is, as an IBM, an electrophotographic photosensitive member in the form of a rotational drum (which hereinafter will be referred to as "photoconductive drum"). In this embodiment, the photoconductive drum 1 is a negatively chargeable organic photoconductor (OPC). It is 20 mm in external diameter, and is rotationally driven about the axial line of the photosensitive drum supporting shaft, at a process speed (peripheral speed) of 130 mm/sec in a direction of an arrow R1.

Figure 2:
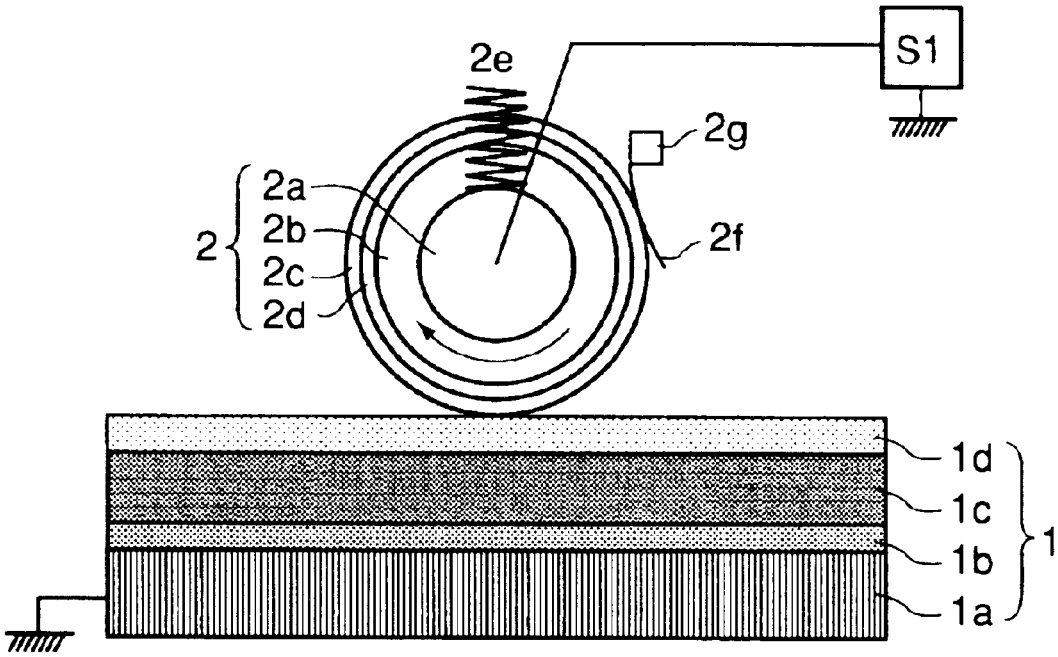
FIG. 2 is a schematic sectional view showing layer structures of an image bearing member 1 and a charging means 2 provided to the image bearing member 1 and a charging means 2 provided to the image forming apparatus of FIG. 1.

Referring to FIG. 2, which schematically shows the laminar structure of the photosensitive drum 1, the photosensitive drum 1 comprises an aluminum cylinder la (electrically conductive drum support), and three functional layers coated in layers on the peripheral surface of the aluminum cylinder 1*a*. The three layers are an undercoat layer 1*b*, an electrical charge generating layer 1*c*, and an (about 20 μm-thick) electrical charge transport layer 1*d*, dispersed in this order on the aluminum cylinder 1*a*. The undercoat layer 1*b* is for suppressing optical interferences and improving the adhesive properties of the layer thereupon to the aluminum cylinder 1*a*.

(b) Charging Means

The printer 100 includes a contact charging apparatus (contact charging device) 2 as a charging means for uniformly charging the peripheral surface of the photosensitive drum 1. In this embodiment, the contact charging apparatus 2 is a charge roller (roller type charging device), which effects charging by utilizing a discharge phenomenon occurring at a minute gap between the charge roller 2 and the photosensitive drum 1. The charging by utilizing the discharge phenomenon has the advantages of a lower voltage applied to the charge roller 2 for charging and less amount of ozone generated. Further, the present invention is particularly effective in such a charging method because toner particles are liable to adhere to the charge roller 2 which contacts the photosensitive drum 1.

The charge roller 2 is rotationally supported by an unshown pair of bearing members, by the lengthwise end portions of its metallic core (supporting member) 2*a*, and is kept pressured toward the photosensitive drum 1 by a pair of compression coil springs 2*e* so that its peripheral surface is kept pressed upon the peripheral surface of the photosensitive drum 1 at a predetermined pressing force. The charge roller 2 is rotated by the rotation of the photoconductive drum 1. The contact nip between the photoconductive drum 1 and charge roller 2 constitutes the charging station a (charging nip).

To the metallic core 2*a* of the charge roller 2, a charge bias voltage, which satisfies predetermined requirements, is applied from an electrical power supply (source) S1, so that as the photosensitive drum 1 is rotated, the peripheral surface of the photosensitive drum 1 is charged to predetermined polarity and potential level by the contact charging treatment. In this embodiment, the charge bias voltage applied to the charge roller 2 is an oscillating voltage, that is, a combination of DC (Vdc) and AC (Vac) voltages. More specifically, it is the combination of DC voltage of −500 V, and AC voltage, which is 1.3 kHz and 1.5 kV in frequency f and peak-to-peak voltage Vpp, respectively, and has a sinusoidal waveform. With the application of this oscillating voltage to the charge roller 2, the peripheral surface of the photosensitive drum 1 is uniformly charged to −500 V (dark part potential Vd) identical to the DC voltage applied to the charge roller 2.

Referring to FIG. 2, which is a schematic drawing for showing the laminar structure of the charge roller 2, the charge roller 2 is 320 mm in length and 14 mm in diameter, r and comprises the aforementioned metallic core 2*a* (supporting member, and three layers, that is, an undercoat layer 2*b*, an intermediary layer 2*c*, and a surface layer 2*d*, which are placed in layers on the peripheral surface of the metallic core 2*a*, in the listed order. The undercoat layer 2*b* is for reducing the charging noises, and is formed of foamed substance such as sponge. The surface layer 2*d* is a protective layer provided for preventing electrical leak even if the peripheral surface of the photoconductive drum 1 has defects such as pin holes.

More specifically, the specification of the charge roller 2 in this embodiment is as follows:

a. metallic core 2*a*: a piece of stainless steel rod with a diameter of 6 kV;

b. undercoat layer 2*b*: formed of foamed EPDM in which carbon black has been dispersed; 0.5 g/cm$^3$ i specific gravity; $10^2$–$10^9$ ohm.cm in volume resistivity; and about 3.0 mm in thickness;

c: intermediary layer 2*c*: formed of NBR in which carbon black has been dispersed; $10^2$–$10^5$ ohm.cm in volume resistivity; and about 500 $\mu$m in thickness; and d. surface layer 2*d*: formed of Toresin resin a fluorinated compound, in which tin oxide and carbon black have been dispersed; $10^7$–$10^{10}$ ohm.cm in volume resistivity; 1.5 $\mu$m in surface roughness (10 point average surface roughness Rz in JIS); and 10 $\mu$m in thickness.

As shown in FIG. 2, a reference numeral 2*f* stands for a charge roller cleaning member. In this embodiment, the charge roller cleaning member is a 25 $\mu$m-thick flexible cleaning film of polyimide. This cleaning film 2*f* is disposed in parallel with the longitudinal (lengthwise) direction of the charge roller 2, and is fixed, by one of its long edges, to a supporting member 2*g* which oscillates a predetermined distance in the direction also parallel with the longitudinal direction of the charge roller 2. Further, the cleaning film 2*f* is positioned so that its portion adjacent to its free edge, that is, the edge by which it is fixed to the supporting member 2, forms a contact nip against the peripheral surface of the charge roller 2.

The supporting member 2*g* is driven by a driving motor (not shown) of the printer 100 through a gear train so that it is oscillated by the predetermined distance in its longitudinal direction. As a result, the surface layer 2*d* of the charge roller 2 is rubbed by the cleaning film 2*f*. By this action of the cleaning film 2*f*, the contaminants (microscopic toner particles, additives, and the like) adhering to the peripheral surface o the charge roller 2 are removed.

(c) Information Writing Means

The printer 100 includes an exposing apparatus 3 as an information writing means for forming an electrostatic latent image on the peripheral surface of the charged photosensitive drum 1. In this embodiment, it is a laser beam scanner employing a semiconductor laser. The laser beam scanner (exposing apparatus) 3 scans (exposes) the uniformly charged peripheral surface of the rotating photosensitive drum 1 with a scanning laser beam L which it projects while modulating the laser beam L with the image formation signals sent to the printer from an unshown host such as an image reading apparatus. This scanning (exposing) is done at an exposing point b, or exposing station. As the result of the scanning of the uniformly charged peripheral surface of the rotating photosensitive drum 1 by this laser beam L, the positions of the peripheral surface of the photosensitive drum 1 illuminated by the laser beam L are reduced in potential level, sequentially effecting an electrostatic latent image in accordance with the image formation information written on the peripheral surface of the photoconductive drum 1 by the scanning laser beam L.

(d) Developing Means

The printer 100 includes a developing apparatus (developing device) 4 as a developing means for reversely developing an electrostatic latent image on the photosensitive drum 1 into a toner image (developer image) by supplying toner in accordance with the electrostatic latent image. In this embodiment it is a reversal developing apparatus employing a two-component contact type developing method in which the development is performed by causing a magnetic brush of a two component developer comprising the toner and a carrier to contact the photosensitive drum.

The developing apparatus 4 includes a developer container 4*a* and a non-magnetic developing sleeve 4*b*. The developing sleeve 4*b* is rotationally disposed within the developer container 4*a* with its peripheral surface partially exposed from the developer container 4*a*. Inside the developing sleeve 4*b*, a magnetic roller 4*c* which is stationarily fixed and disposed within the hollow of the developing sleeve 4*b*. A developer coating blade 4*d* is disposed opposite to the developing sleeve 4*b*. The two-component developer 4*e* is stored in the developer container 4*a*. Developer stirring members 4*f* are positioned in the bottom portion of the developer container 4*a*. A toner hopper 4*g* contains replenishment toner.

The two-component developer 4*e* in the developer container 4*a* is a mixture of non-magnetic toner and magnetic carrier, and is stirred by the developer stirring members 4*f*. In this embodiment, the electrical resistance of the magnetic carrier is approximately $10^{13}$ ohm.cm, and its (volume-average) particle size measured in such a manner that particles in the range of 0.5–350 $\mu$m are divided into 32 portions logarithmically by using a laser diffraction-type particle size measuring apparatus ("HEROS", md. by Nippon Denshi K. K.) and a median diameter providing 50% of volume is determined as a volume-average particle size is about 40 $\mu$m. The toner is negatively charged by the friction between the toner and magnetic carrier.

The developing sleeve 4*b* is disposed in parallel with the photoconductive drum 1 so that the shortest distance (S-D gap) between the peripheral surfaces of the developing sleeve 4*b* and photosensitive drum 1 is maintained at 350 $\mu$m. Where the distance between the peripheral surfaces of the developing sleeve 4*b* and photosensitive drum 1 is shortest, and its adjacencies, constitute the development station c. The developing sleeve 4*b* is rotationally driven in such a direction that its peripheral surface moves in the direction opposite to the peripheral surface of the photosensitive drum 1, in the development station c. A part of the two-component developer 4*e* in the developer container 4*a* is adsorbed and held to the peripheral surface of the developing sleeve 4*b* by the magnetic force of the magnetic roller 4*c* in the development sleeve 4*b*, forming a magnetic brush layer. As the developing sleeve 4*b* is rotated, the magnetic brush layer moves with the peripheral surface of the development sleeve 4*b*, and as it moves with the peripheral surface of the developing sleeve 4*b*, its thickness is reduced by the developer coating blade 4*d* to a predetermined one to come into contact with the peripheral surface of the photosensitive drum 1 and properly rubs the peripheral surface of the photosensitive drum 1, in the development station c. By the contact of the magnetic brush with the photosensitive drum 1 as the image bearing member, an effect of scraping the transfer residual toner off the photosensitive drum 1 is attained, thus improving a recovery efficiency of the transfer residual toner. Further, by moving the peripheral surfaces of the photosensitive drum 1 and the developing sleeve 4*b* opposite from each other, the scraping effect is further enhanced, thus allowing more efficient recovery of the transfer residual toner.

To the developing sleeve 4*b*, a predetermined developing bias voltage is applied from an electrical power supply S2. In this embodiment, the developing bias voltage applied to the developing sleeve 4*b* is an oscillating voltage, that is, a combination of DC (Vdc) and AC (Vac) voltages. More specifically, it is the combination of C voltage: −350 V, and AC voltage, which is 8.0 kHz and 1.8 kV in frequency f and peak-to-peak voltage pp, respectively, and has a rectangular waveform.

Through the process described above, the two-component developer 4*e* is coated in a thin layer on the peripheral surface of the rotating development sleeve 4*b*, and is conveyed to the development station c, in which the toner portion of the developer 4*e* is adhered to the selected portions, that is, the portions of the peripheral surface of the photosensitive drum 1 corresponding to the pattern of the electrostatic latent image, by the electrical field generated by the development bias voltage. As a result, the electrostatic latent image is developed into a toner image. In this embodiment, the toner adheres to the exposed portions, that is, the illuminated portions, of the peripheral surface of the photosensitive drum 1; in other words, the electrostatic latent image is developed in reverse.

The amount of the electrical charge, which the toner particles have after being adhered to the peripheral surface of the photoconductive drum 1, is −25 $\mu$m in the environment which is 23° C. in temperature, and 10.5 g/m$^3$ in absolute humidity.

As the developing sleeve 4*b* is further rotated, the portion of the thin layer of the developer on the developing sleeve 4*b*, which passed through the development station c, is conveyed back into the developer pocket in the developer container 4*a*.

In order to keep the toner concentration of the two-component 4*e* in the developer container 4*a* within a predetermined approximate range, the following system is provided: The toner concentration of the two-component developer in the developer container 4*a* is detected by, for example, an optical toner concentration sensor, and the toner hopper 4*g* is driven in response to the toner concentration information detected by the sensor, so that the toner within the toner hopper 4*g* is supplied to the two-component developer 4*e* within the developer container 4*a*. After being supplied to the two-component developer 4*e*, the toner is stirred by the stirring members 4*f*.

(e) Transfer Means and Fixing Means

The printer 100 includes a transfer apparatus 5 as a transfer means. In this embodiment, the transfer apparatus 5 is a transfer roller. The transfer roller 5 is kept pressed upon the photosensitive drum 1 at a predetermined pressing force, forming a compression nip against the peripheral surface of the photosensitive drum 1. This compression nip constitutes the transfer station d. To this transfer station d, a recording material is delivered from an unshown sheet feeding mechanism at a predetermined control timing.

As the recording material P is delivered to the transfer station d, it is nipped between the peripheral surfaces of the photosensitive drum 1 and transfer roller 5, and is conveyed further while remaining nipped.

While the recording material P is conveyed through the transfer station d, being nipped by the peripheral surfaces of the photosensitive drum 1 and transfer roller 5, a transfer bias voltage with the positive polarity, which is +2 kV in this embodiment and is opposite to the negative (normal) polarity of the toner, is applied to the transfer roller 5 from an electrical power supply S3. As a result, the toner image on the peripheral surface of the photosensitive drum 1 is transferred, electrostatically and sequentially, onto the surface of the recording material P as the recording material P is conveyed through the transfer station d, remaining nipped by the photosensitive drum 1 and transfer roller 5. The polarity of the transfer bias, which is positive, is opposite to the normal polarity (negative polarity) to which toner particles becomes charged.

After receiving the toner image while being passed through the transfer station d, the recording material P is continually separated, starting from its leading end, from the peripheral surface of the photosensitive drum 1, and is conveyed to the fixing apparatus 6 (a heat roller type fixing apparatus in this embodiment), in which the toner image is fixed. Thereafter the recording material P is outputted as an image-formed product (print or copy).

(2) Cleaner-less System Auxiliary Charging Means and Control of Applied Voltage

The printer 100 in this embodiment is of a cleaner-less type. In other words, it is not equipped with a cleaning apparatus dedicated to the removal of the residual toner particles, that is, a small amount of toner particles remaining on the peripheral surface of the photosensitive drum 1 after the transfer of the toner image onto the recording material P. Thus, after the transfer, the residual toner particles on the peripheral surface of the photosensitive drum 1 are conveyed farther by the rotation of the photosensitive drum 1 through the charging station a and exposing station b, and to the development station c, in which they are removed (recovered) by the developing apparatus 4 at the same time as the development process is carried out by the developing apparatus (cleaner-less system).

In this embodiment, the developing sleeve 4*b* of the developing apparatus 4 is rotated in such a direction that in the development station c, the peripheral surface of the developing sleeve 4*b* moves in the direction opposite to the peripheral surface of the photosensitive drum 1, as described before. Rotating the developing sleeve 4*b* in this manner is advantageous for the recovery of the residual toner particles on the peripheral surface of the photosensitive drum 1.

Since the residual toner particles on the peripheral surface of the photosensitive drum 1 go through the exposing station b, the peripheral surface of the photosensitive drum 1 is exposed with the presence of the residual toner particles on the peripheral surface.

However, the amount of the residual toner particles is very small, and therefore, the presence of the residual toner particles does not greatly affect the exposing process, except for the following.

As described hereinbefore, in terms of polarity, the transfer residual toner is the mixture of the normally charged (negatively charged) toner particles and reversely charged (positively charged) toner particles (reversal toner particles). Further, some of the charged toner particles have an insufficient amount of electrical charge. Thus, as the residual toner passes through the charging station a, the reversely charged toner particles and the insufficiently charged toner particles are adhered to the charge roller 2, contaminating the charge roller 2 beyond the tolerable range to cause charging failure (AREA (1) shown in FIG. 3).

Further, in order to effectively remove the residual toner particles on the peripheral surface of the photosensitive drum 1 by the developing apparatus 4 at the same time as the developing process is carried out by the developing apparatus 4, the amount of electric charge of the transfer residual toner becomes an important factor. More specifically, it is preferable that the residual toner particles on the photosensitive drum 1, which are being conveyed to the development station c, are normal in polarity, and also that the amount of the electric charge, which they hold, is proper for an electrostatic latent image on the photosensitive drum 1 to be satisfactorily developed by the developing apparatus. The reversely charged toner particles and the toner particles with an unsatisfactory amount of electrical charge cannot be removed (recovered) from the photosensitive drum 1 by the developing apparatus 4, thus being liable to cause image defects.

In this embodiment, the electrostatic latent image erase means 8 and the toner charging means 7 are brush-shaped members with an appropriate electroconductivity, and are disposed so that their brush portions contact the surface of the photosensitive drum 1 to contact areas f and e with the photosensitive drum surface, respectively.

The brush-shaped member has a wide contact area with a member to be charged, thus allowing efficient charging. Further, the brush-shaped member also has such an advantage that its oscillates by the friction with the rotating photosensitive drum 1 to facilitate removal of the adhered toner.

To the electrostatic latent image erase means 8, the positive DC voltage is applied from the power supply S5, and to the toner charging means 7, the negative DC voltage is applied from the power supply S4. The values of the DC voltages applied to these means 8 and 7 are changed, depending on absolute humidities calculated from temperatures and relative humidities detected by a thermohygrometer provided in the apparatus, as shown in FIGS. (a) and (b), respectively. For example, in an environment of a temperature of 23° C. and an absolute humidity of 10.5 g/m$^3$, the DC voltage of +250 V and the DC voltage of −750 V are applied to the electrostatic latent image erase means 8 and the toner charging means 7, respectively.

Figure 3:
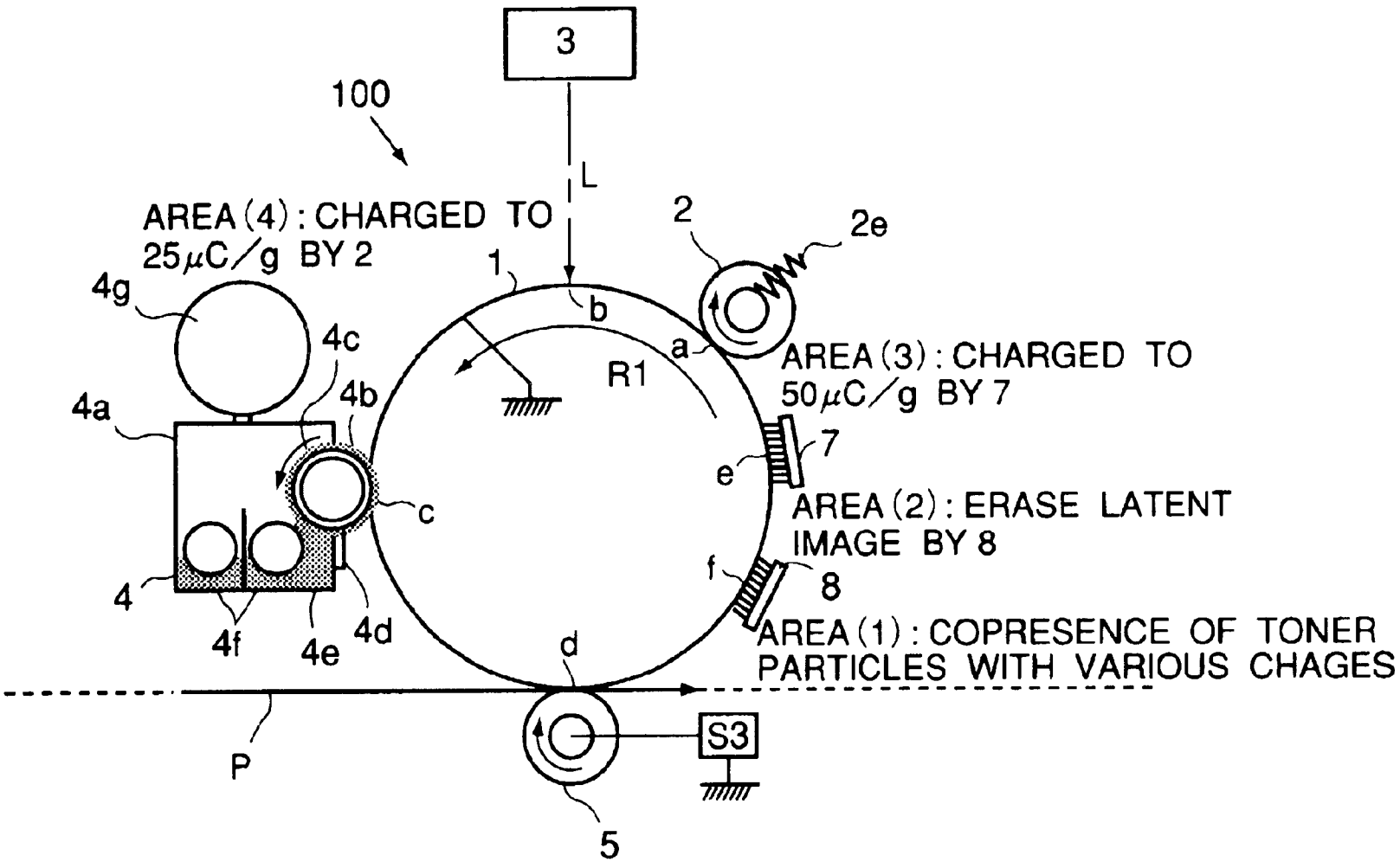
FIG. 3 is a schematic sectional view for illustrating a cleaner-less system of the image forming apparatus of the present invention.

At the transfer station d after the toner image is transferred onto the recording material P, the electrostatic latent image on the surface of the photosensitive drum 1 is erased by the electrostatic latent image erase means 8 so as to uniformize the surface potential of the photosensitive drum 1 (AREA (2) shown in FIG. 3).

Then, the transfer residual toner remaining on the photosensitive drum 1 surface reaches the contact portion e between the toner charging means 7 and the photosensitive drum 1, where the charge polarity of the toner is uniformized to be negative (the normal polarity) by the toner charging means 7, and the transfer residual toner is electrical repulsive to the charging means 2, so that a sufficient amount of electric charge is imparted to the transfer residual toner (AREA (3) shown in FIG. 3).

As described above, the transfer residual toner is electrically charged to the negative charge polarity being the normal polarity and a sufficient electric charge is imparted to the transfer residual toner by the electrical repulsion of the transfer residual toner to the charging means 2. Then, the electrical repulsive force between the transfer residual toner and the charging means 2 becomes larger, thus preventing the transfer residual toner from adhering to the charge roller 2 at the time of charge-treating the surface of the photosensitive drum 1 through the transfer residual toner at the contact portion (charging station) a between the charge roller 2 and the photosensitive drum 1. Therefore, the amount of electric charge imparted to the charge roller 2 by the toner charging means 7 may preferably be about two times the toner charge amount at the time of the developing, specifically, e.g., be about −50 $\mu$C/g in the environment of 23° C. (temperature) and 10.5 g/m$^3$ (absolute humidity).

Next, the recovery of the transfer residual toner in the developing process will be described.

The developing apparatus 4, as described above, cleans the photosensitive drum surface and recovers the transfer residual toner at the same time with the development. The (average) toner charge amount used for developing the electrostatic latent image on the photosensitive drum 1 is about −25 $\mu$C/g in the environment of 23° C. (temperature) and 10.5 g/m$^3$ (absolute humidity).

In order to sufficiently recover the transfer residual toner on the photosensitive drum 1 into the developing apparatus 4, the charge amount of the transfer residual toner which reaches the developing apparatus 4 may preferably be in the range of ca. 15–35 $\mu$C/g. However, as described above, in order to prevent the toner adhesion to the charge roller 2, it is necessary to charge-removing the transfer residual toner, which has been largely charged to the negative polarity (−50 $\mu$C/g), so as to be recovered by the developing apparatus 4.

To the charge roller 2, a voltage comprising a DC voltage (−450 V) superposed with an AC voltage (frequency: 1.3 kHz, peak-to-peak voltage Vpp: 1.5 kV) is applied in order to charge-treating the photosensitive drum 1 surface. At this time, the transfer residual toner on the photosensitive drum 1 is charge-removed by the AC voltage at the same time when the charge roller 2 electrically charges the surface of the photosensitive drum 1. In such an AC voltage condition, the charge amount of the transfer residual toner is changed from about −50 $\mu$C/g after passing through the charging station a. As a result, the transfer residual toner adhered to the portion (non-image portion) to which the toner remaining on the photosensitive drum 1 should not be adhered, is recovered into the developing apparatus 4 (AREA (4) shown in FIG. 3).

As described above, (i) the charge amount of the transfer residual toner conveyed from the transfer station d to the charging station a by the rotational movement of the photosensitive drum 1 is controlled so that the transfer residual toner is charge-treated uniformly to the negative (normal) polarity by the toner charging means 7, whereby the adhesion of the transfer residual toner to the charge roller 2 is prevented, and (ii) the charge amount of the transfer residual toner charge-treated to the negative (normal) polarity by the toner charging means 7 is controlled to be approximately equal to that for developing the electrostatic latent image on the photosensitive drum 1 by the developing apparatus 4 at the same time when the photosensitive drum 1 is electrically charged to a predetermined potential by the charge roller 2, whereby the recovery of the transfer residual toner by the developing apparatus is efficiently performed.

According to the above-described cleaner-less system, particularly the simultaneous developing and cleaning scheme, it is not necessary to particularly provide a cleaning apparatus which has been ordinarily used conventionally, and it becomes possible to reuse the transfer residual toner without generating the waste toner. As a result, the image forming apparatus using such a system or scheme is preferable in terms of obviation of troublesome maintenance, downsizing of the apparatus, environmental protection, effective utilization of resources, etc.

However, after the image forming apparatus described in the above embodiment is used for a long time, additives are adhered to and accumulated on the surface of the electrostatic latent image erase means 8 and the toner charging means 7 and the electrical resistances of these means are increased due to application of the DC voltage for a long time. As a result, the effects of these means on the transfer residual toner are diminished to result in an insufficient control of the charge amount of the transfer residual toner. Consequently, there are possibilities such that the transfer residual toner adheres to the charge roller 2 surface to cause charging failure and that the transfer residual toner is not recovered into the developing apparatus to be still carried on the photosensitive drum 1 surface without being recovered.

Figure 5:
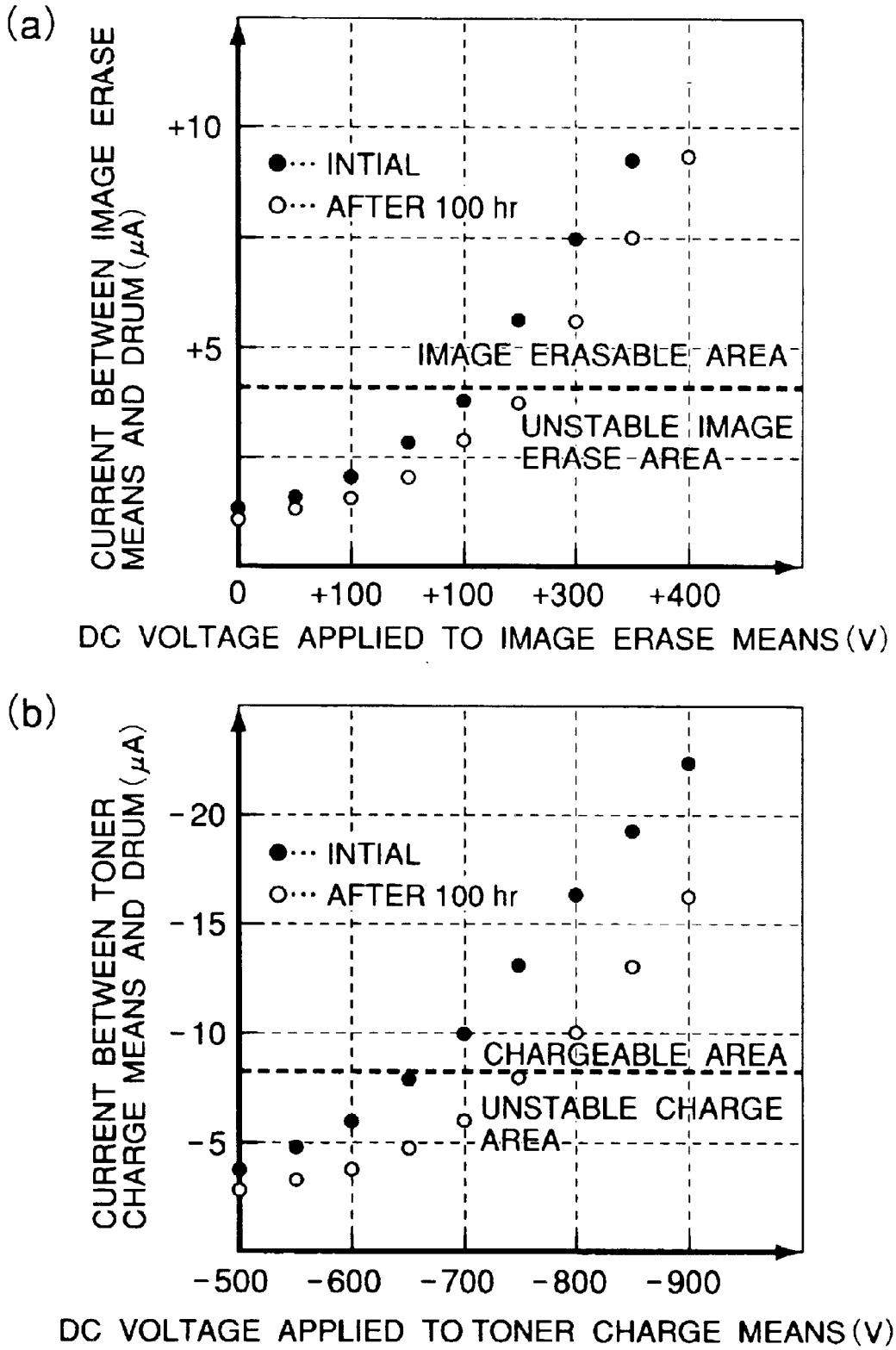
FIG. 5(*a*) is a graph showing a relationship between the DC voltage applied to the electrostatic latent image erase means 8 and an amount of current flowing through an image bearing member 1, and FIG. 5(*b*) is a graph showing a relationship between the DC voltage applied to the toner charging means and an amount of current flowing through the image bearing member 1.

FIG. 5(*a*) is a graph showing a relationship between a voltage value applied to the electrostatic latent image erase means 8 and a current value flowing from the electrostatic latent image erase means 8 to the photosensitive drum 1, in an environment of an absolute humidity of 10.6 g/m$^3$. In the case where a current value not less than the dotted line level (4 $\mu$A) passes through the photosensitive drum 1, it is possible to sufficiently erase the electrostatic latent image. On the other hand, if the current is less than the dotted line level (4 $\mu$A), erasure of the electrostatic latent image becomes unstable.

More specifically, referring to FIG. 5(*a*), when the DC voltage value applied to the electrostatic latent image erase means 8 is +250 V at the initial stage, the resultant current value flowing from the electrostatic latent image erase means 8 to the photosensitive drum 1 is about −6 $\mu$A. However, after the image forming apparatus is used for a long time (i.e., after the electrostatic latent image erase means 8 is energized with the DC voltage for 100 hours), the electrical resistance of the electrostatic latent image erase means 8 is increased, so that only the current of about +3.5 $\mu$A flows. Accordingly, erasure of the electrostatic latent image becomes unstable.

Similarly, FIG. 5(*b*) is a graph showing a relationship between a voltage value applied to the toner charging means 7 and a current value flowing from the toner charging means 7 to the photosensitive drum 1, in an environment of an absolute humidity of 10.6 g/m$^3$. In the case where a current value not less than the dotted line level (−8 $\mu$A) as absolute value passes through the photosensitive drum 1, it is possible to impart a sufficient amount of electric charge to the transfer residual toner so as to prevent the adhesion of the transfer residual toner to the charge roller 2. On the other hand, if the current is less than the dotted line level (−8 $\mu$A) as absolute value, it becomes impossible to impart the sufficient charge amount to the transfer residual toner, so that a part of the transfer residual toner adheres to the charge roller 2 surface.

More specifically, referring to FIG. 5(*b*), when the DC voltage value applied to the toner charging means 7 is −750 V at the initial stage, the resultant current value flowing from the toner charging means 7 to the photosensitive drum 1 is about −13 $\mu$A. However, after the image forming apparatus is used for a long time (i.e., after the toner charging means 7 is energized with the DC voltage for 100 hours), the electrical resistance of the toner charging means 7 is increased, so that only the current of about −7.5 $\mu$A flows. Accordingly, the impartment of the electric charge to the transfer residual toner by the toner charging means 7 becomes insufficient.

Figure 10:
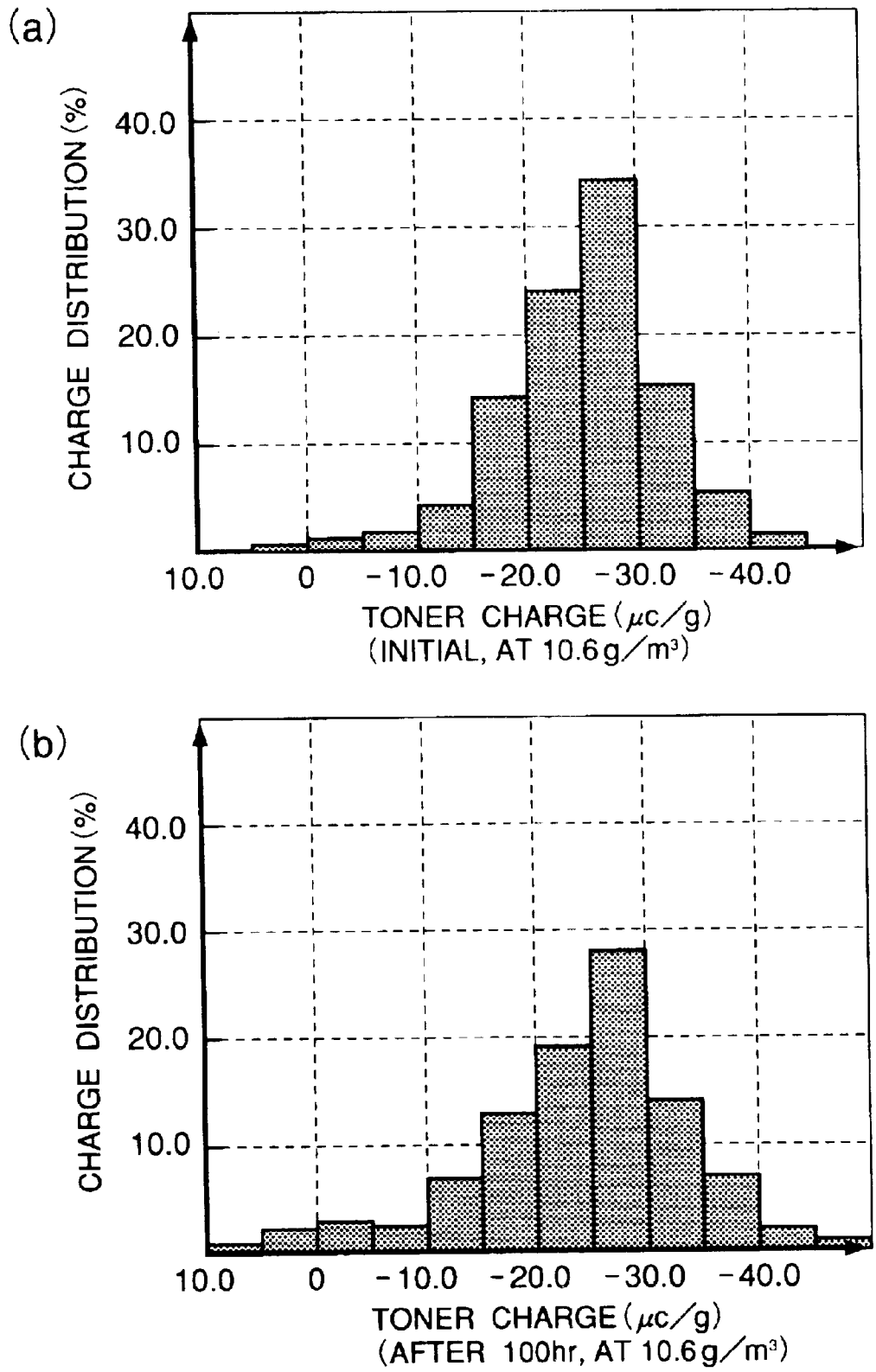
FIG. 10(*a*) is a graph showing a distribution of the amount of charge of toner developed by a developing means at an initial stage of use of the image forming apparatus of the present invention, and FIG. 10(*b*) is a graph showing a distribution of the amount of the toner developed by the developing means after the image forming apparatus is used for a long period of time.

FIGS. 10(*a*) and 10(*b*) show charge amount distributions of the toner developed on the photosensitive drum 1 by the developing apparatus 4 in an environment of an absolute humidity of 10.6 g/m$^3$, wherein the charge amount distribution of the developing toner at the initial stage is shown at (a), and that after the DC voltage is applied for 100 hours to the toner charging means 7 (or the electrostatic latent image erase means 8) is shown at (b).

The developing toner charge distribution at the initial stage provides a sharp shape having a center value of −20 to −30 $\mu$C/g to some extent. On the other hand, after the lapse of 100 hours, it has been found that a proportion of toner particles having the charge amount level of −20 to −30 $\mu$C/g is lowered and that a proportion of toner particles which have smaller charge amounts (0 to −10 $\mu$C/g) or are inverted in polarity is increased. As a result, it has been confirmed that the transfer residual toner contains an increased amount of toner particles which are inverted in polarity or have the smaller charge amounts after the image forming apparatus is used for a long time compared with the initial stage.

As a result of study by the inventor, it has been found that it is possible to not only prevent the adhesion of the transfer residual toner to and accumulation in the charge roller 2 by effecting an appropriate control of the charge amount of the transfer residual toner to efficiently remove and recover the transfer residual toner by the developing apparatus 4 but also stably charge the photosensitive drum 1 by the charge roller 2, on the basis of performing control described below, even in the case of using the image forming apparatus for a long period of time.

More specifically, in this embodiment, such a control that control values of DC voltages applied to the toner charging means 7 and the electrostatic latent image erase means 8 are continuously increased linearly on the basis of integrated time of voltage application (voltage application integration time) to the toner charging means 7 and the electrostatic latent image erase means 8 as the amounts of operation of the image forming apparatus, is performed by the control means 10.

The voltage application integration time is recorded by the recording means 11. Specifically, the recording means 11 records the times of application of DC voltages of the toner charging means 7 and the electrostatic latent image erase means 8 and stores the integral of the recorded values in a memory as desired.

Based on the voltage application integration time stored in the memory, the control values of the applied voltages are calculated by the control means 10 (CPU: central processing unit) in accordance with a predetermined relationship (linear function in this embodiment), and then are applied to the toner charging means 7 and the electrostatic latent image erase means 8, respectively.

Figure 6:
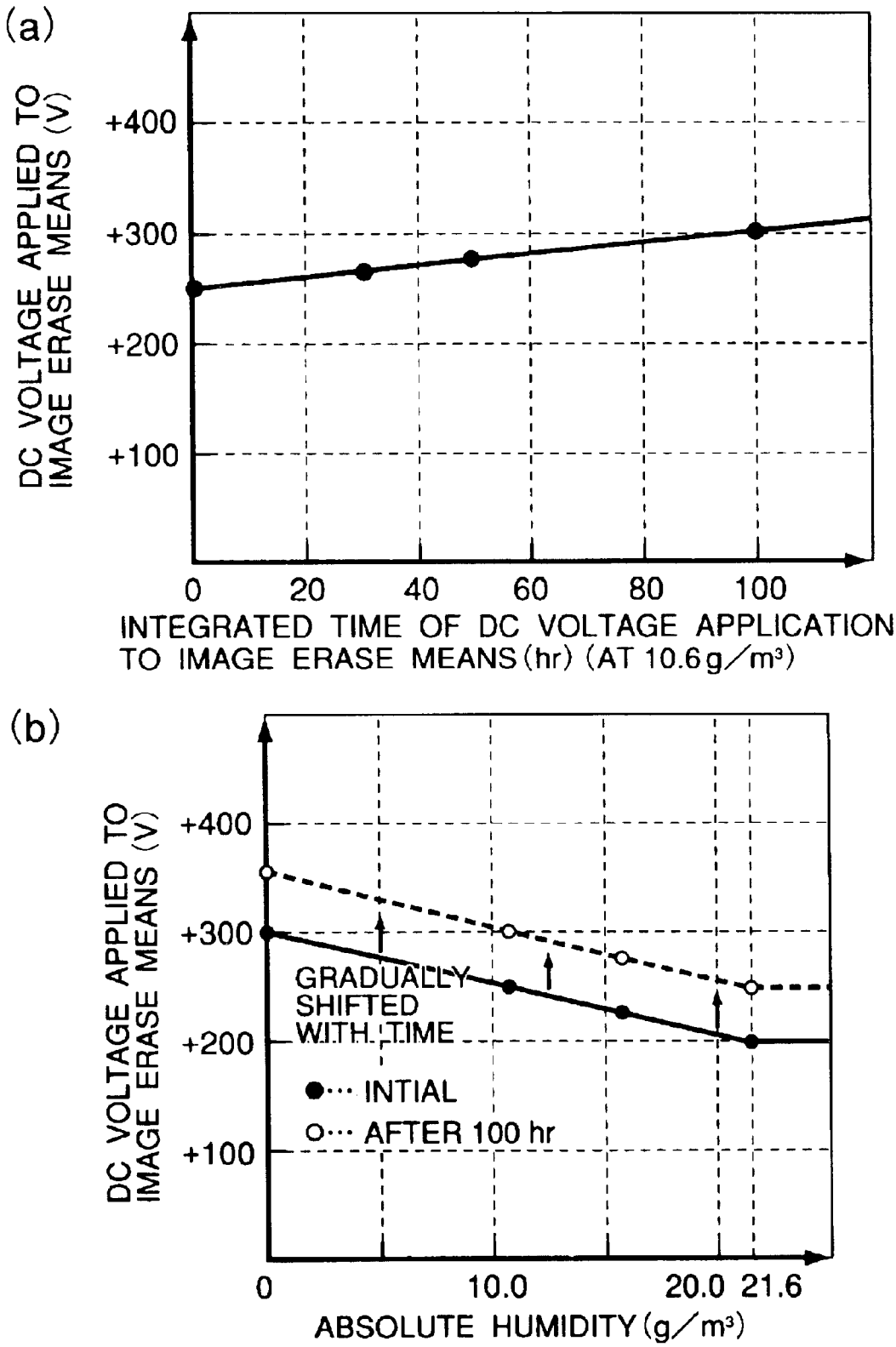
FIG. 6(*a*) is a graph showing a relationship between an integrated value of time of DC voltage application to and a control value of the DC voltage applied to the electrostatic latent image erase means 8, and FIG. 6(*b*) is a graph showing a relationship between the absolute humidity and the control value of the DC voltage applied to the electrostatic latent image erase means 8, in an embodiment of the image forming apparatus.

FIG. 6(*a*) is a graph showing a relationship between the voltage application integration time for the electrostatic latent image erase means 8 and the control value of DC voltage applied to the electrostatic latent image erase means 8 at each timing when the image forming apparatus of this embodiment is used in the environment of the absolute humidity of 10.6 g/m$^3$. In this embodiment, the control value of DC voltage applied to the electrostatic latent image erase means 8 is controlled so that the control value is linearly increased with the voltage application integration time.

Figure 4:
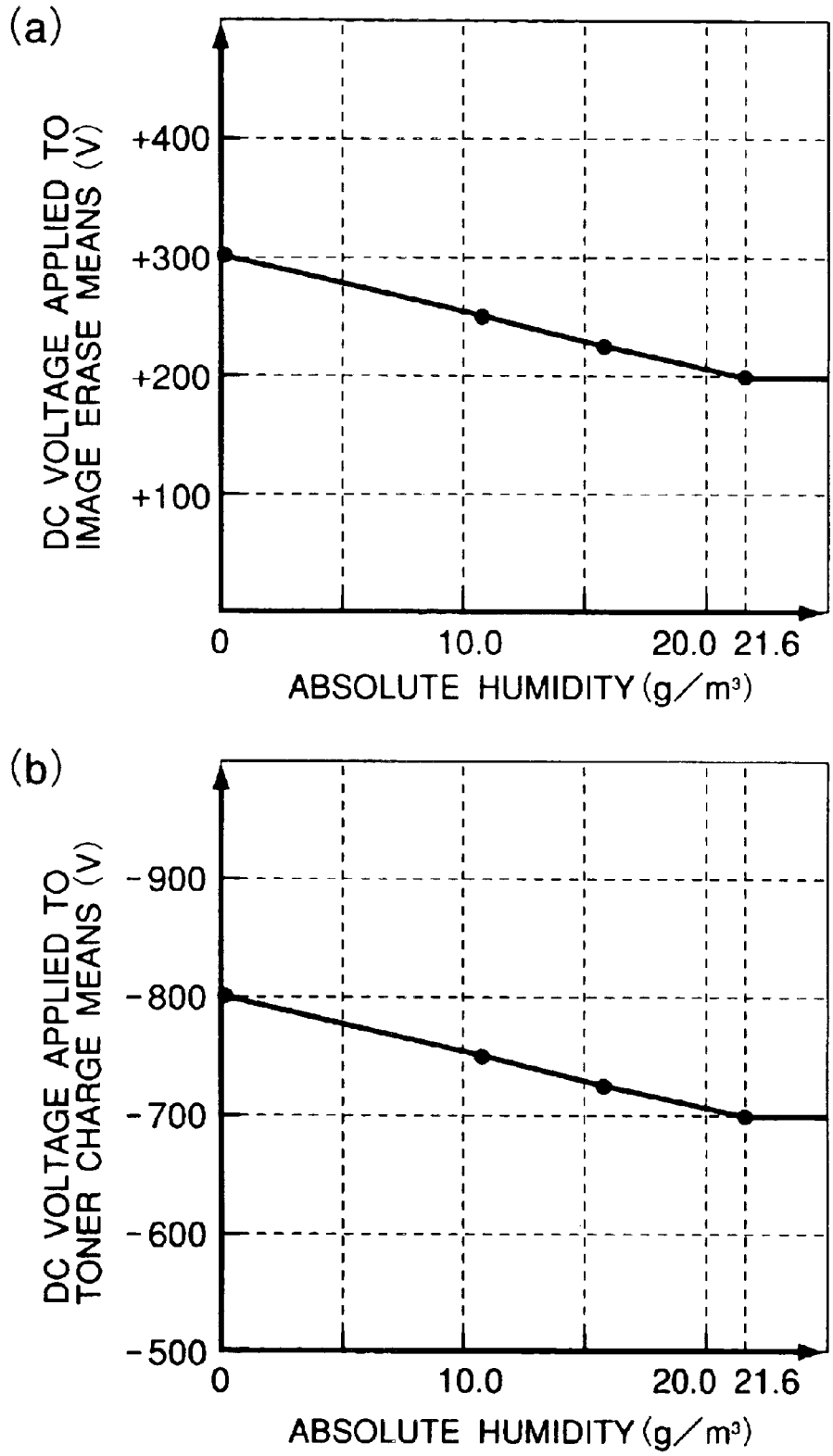
FIG. 4(*a*) is a graph showing a relationship between an absolute humidity and a DC voltage applied to an electrostatic latent image erase means 8, and FIG. 4(*b*) is a graph showing a relationship between an absolute humidity and a DC voltage applied to a toner charging means 7.

More specifically, a control value (Vdc 1(t)) of DC voltage applied to the electrostatic latent image erase means 8 at a timing (t: voltage application integration time) can be represented by the following equation (1):

$$Vdc\ \mathbf{1}(t)=Vdc\ \mathbf{1}(\mathbf{0})+50\times(t/100) \quad (1),$$

wherein Vdc 1(0) represents an initial control value of DC voltage applied to the electrostatic latent image erase means 8 at the initial stage and is determined on the basis of the absolute humidity within the image forming apparatus as shown in FIG. 4(*a*) (+250 V in the environment of the absolute humidity of 10.6 g/m$^3$).

For example, when the voltage application integration time for the electrostatic latent image erase means 8 is 100 hours, the control value of the DC voltage applied to the electrostatic latent image erase means 8 is increased up to +300 V relative to the initial control value (+250 V). This is because, as shown in FIG. 5(*a*), the electrostatic latent image erase means 8 is increased in electrical resistance at the voltage application integration time of 100 hours by, e.g., energization deterioration to lower the current amount flowing from the electrostatic latent image erase means 8 into the photosensitive drum 1. More specifically, when the control value of DC voltage applied to the electrostatic latent image erase means 8 is +250 V, the amount of current flowing from the electrostatic latent image erase means 8 into the photosensitive drum 1 is about +6 $\mu$A at the initial stage but is lowered to about +3.5 $\mu$A after the lapse of 100 hours. For this reason, it becomes impossible to sufficiently charge-remove the transfer residual toner.

In order to sufficiently erase the electrostatic latent image, it is necessary to provide the control value of DC voltage so that the current amount flowing from the electrostatic latent image erase means 8 into the photosensitive drum 1 is substantially equal to that at the initial stage. As a result, the control value is required to be about +300 V from the relationship shown in FIG. 5(*a*).

As described above, such a control that the control value of DC voltage applied to the electrostatic latent image erase means 8 is continuously increased in accordance with the voltage application integration time for the electrostatic latent image erase means 8 is performed, whereby it becomes possible to erase the electrostatic latent image on the photosensitive drum 1 stably over a long period of time.

Figure 7:
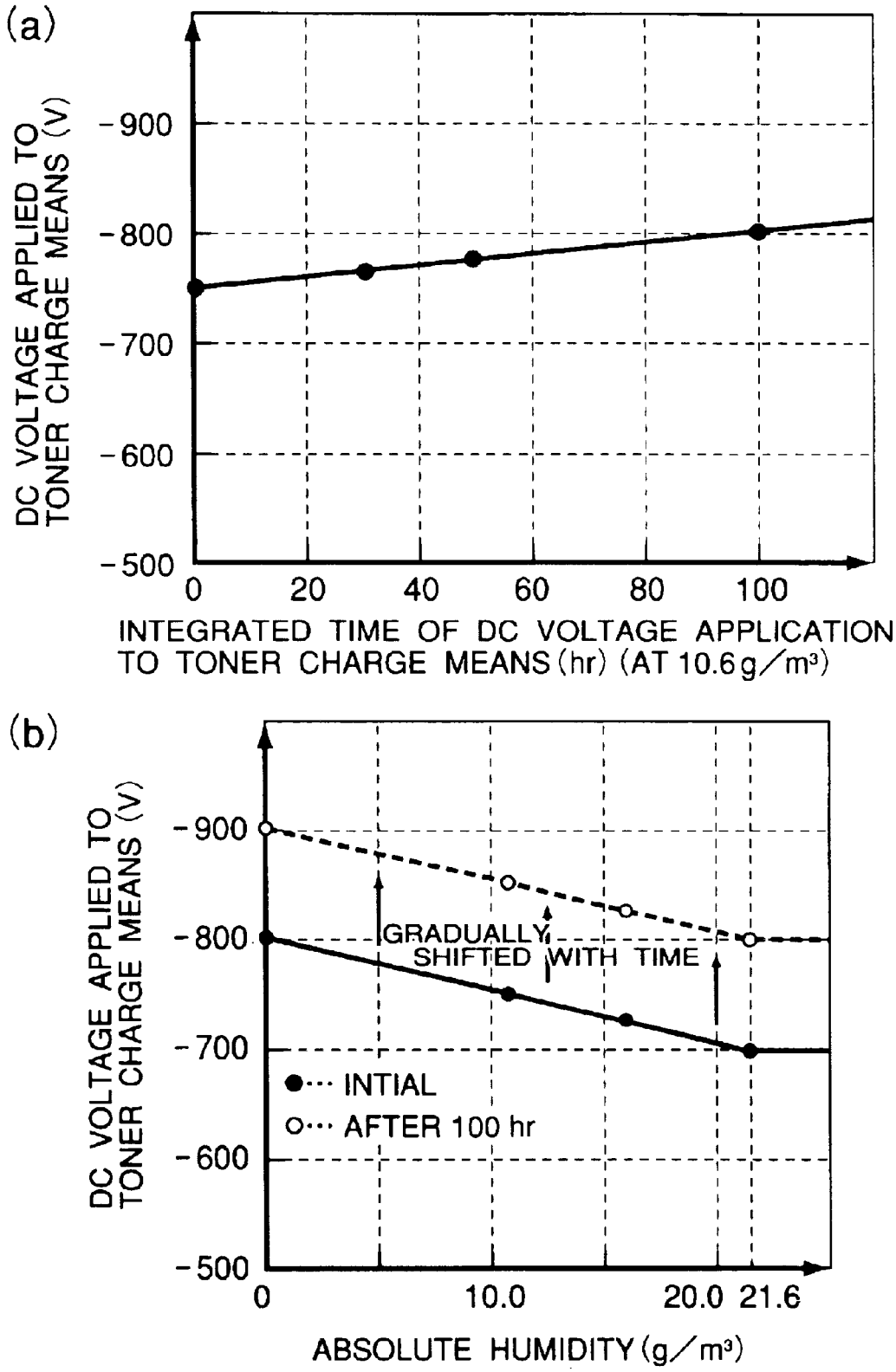
FIG. 7(*a*) is a graph showing a relationship between an integrated value of time of DC voltage application to and a control value of the DC voltage applied to the toner charging means 7, and FIG. 7(*b*) is a graph showing a relationship between the absolute humidity and the control value of the DC voltage applied to the toner charging means 7, in an embodiment of the image forming apparatus.

Similarly as in the case of the electrostatic latent image erase means 8, FIG. 7(*a*) is a graph showing a relationship between the voltage application integration time for toner charging means 7 and the control value of DC voltage applied to the toner charging means 7 at each timing when the image forming apparatus of this embodiment is used in the environment of the absolute humidity of 10.6 g/m$^3$. In this embodiment, the control value of DC voltage applied to the toner charging means 7 is controlled so that the control value is linearly increased with the voltage application integration time recorded by the recording means 11.

More specifically, a also in the case of the toner charging means 7, control value (Vdc 2(t)) of DC voltage applied to the toner charging means 7 at a timing (t: voltage application integration time) can be represented by the following equation (2):

$$Vdc\ \mathbf{2}(t)=Vdc\ \mathbf{2}(\mathbf{0})+(-100)\times(t/100) \quad (2),$$

wherein Vdc 2(0) represents an initial control value of DC voltage applied to the toner charging means 7 at the initial stage and is determined on the basis of the absolute humidity within the image forming apparatus as shown in FIG. 4(*b*) (−750 V in the environment of the absolute humidity of 10.6 g/m$^3$).

For example, when the voltage application integration time for the toner charging means 7 is 100 hours, the control value of the DC voltage applied to the toner charging means 7 is increased, as an absolute value, up to −850 V relative to the initial control value (−750 V). This is similarly attributable to the relationship shown in FIG. 5(*a*). More specifically, in order to impart the charge amount, necessary to prevent the adhesion of the transfer residual toner to the charge roller 2, to the transfer residual toner when the voltage application integration time for the toner charging means 7 is 100 hours, it is necessary to apply the DC voltage of about −850 V to the toner charging means 7 on the basis of the relationship shown in FIG. 5(*b*).

Further, the absolute value of DC bias voltage applied to the toner charging means 7 is set to be larger than that of bias voltage applied to the charging means 2, whereby the toner adhesion to the charging means (charger) 2 is more effectively prevented, and the recovery of the transfer residual toner by the developing device 4 can also be sufficiently performed.

When the absolute value of DC bias voltage applied to the toner charging means 7 is increased, an amount of electric charge imparted from the toner charging means 7 to the transfer residual toner is increased, so that the transfer residual toner is less liable to adhere to the charging means 2. However, the amount of electric charge of the transfer residual toner is too large, a sufficient recovery of the transfer residual toner by the developing means 4 is not performed. For this reason, the electric charge of the transfer residual toner is removed by setting the absolute value of bias voltage applied to the charging means 2 to be smaller than that of DC bias voltage applied to the toner charging means 7, so that it becomes possible to sufficiently recover the transfer residual toner by the developing device 4.

As described above, such a control that the control value of DC voltage applied to the toner charging means 7 is continuously increased in accordance with the voltage application integration time for the toner charging means 7 is performed, whereby it becomes possible to control the charge amount of the transfer residual toner stably over a long period of time.

Incidentally, the polarity of DC voltage applied to the toner charging means 7 is identical to that of DC voltage applied to the charge roller 2, i.e., the polarity used for charge-treating the surface of the photosensitive drum 1. As a result, the toner charging means 7 also has the function of charge-treating the surface of the photosensitive drum 1. In the environment of the absolute humidity of 10.6 g/m$^3$, when the DC voltage of −850 V is applied to the toner charging means 7, the surface of the photosensitive drum 1 is electrically charged to about −350 V.

For this reason, after the image forming apparatus is used for a long period of time, when the electrical resistance of the charge roller 2 is increased due to the adhesion of external additives thereto and/or energization deterioration, thereby to lower the charging performance (ability) of the charge roller 2 to the photosensitive drum 1, it becomes also possible to stably charge-treat the photosensitive drum 1 surface by increasing the DC voltage applied to the toner charging means 7.

As described above, according to this (first) embodiment, the control that the control value of DC voltage to be applied to the toner charging means 7 and the electrostatic latent image erase means 8 is continuously increased linearly on the basis of the voltage application integration time for the toner charging means 7 and the electrostatic latent image erase means 8 as the amount of operation (operation history) of the image forming apparatus, whereby it becomes possible to control the charge amount of the transfer residual toner even in the case where accumulation of external additives or energization deterioration is caused to occur with respect to the toner charging means 7 and the electrostatic latent image erase means 8 after the image forming apparatus is used for a long time. As a result, it is possible to prevent the adhesion of the transfer residual toner to the charge roller 2 and the recovery failure of the transfer residual toner into the developing apparatus 4. Further even in the case where the charge roller 2 is deteriorated, the charge treatment of the surface of the photosensitive drum 1 can be performed uniformly and stably.

The toner charging means 7 and the electrostatic latent image erase means 8 are not limited to the fixed brush-shaped member but may be any shaped members, such as a rotating brush member, an elastic roller and a sheet-shaped member.

The contact charging member 2 may be a fur brush-shaped or made of, e.g., a felt. It is possible to provide a contact charging member which possesses appropriate characteristics in terms of elasticity, electroconductivity, surface properties, durability, etc., by the use of combinations of various materials thereof.

The image bearing member may be the one of direct injection charging type wherein an electron injection layer having a surface volume resistivity o $10^9$–$10^{14}$ ohm.cm is disposed. Even when such an electron injection layer is not used, a similar effect is attained, e.g., if the charge transport layer has the above-ranged volume resistivity. The image bearing member may also be an amorphous silicon photosensitive member which includes a surface layer having a volume resistivity of $10^3$ ohm.cm.

<Embodiment 2>

Next, a second embodiment of the present invention will be described.

In this embodiment, the general structure of an image forming apparatus (laser beam printer) is similar to that of the image forming apparatus used in Embodiment 1. Accordingly, respective members having the same function and structure identical to those of the printer 100 used in Embodiment 1 are represented by identical reference numerals or symbols and detailed explanations therefor are omitted.

In Embodiment 1, the control such that the control values of DC voltages to be applied to the toner charging means 7 and the electrostatic latent image erase means 8 were continuously increased linearly in accordance with the integrated time values of voltage application to the toner charging means 7 and the electrostatic latent image erase means 8 as the amount of operation of the image forming apparatus was performed by the control means 10.

However, in Embodiment 1, the control values of DC voltages are continuously increased linearly on the basis of the voltage application integration time values, so that a high DC voltage is applied even when the toner charging means 7 and/or the electrostatic latent image erase means 8 is not deteriorated by continuous energization, thus accelerating the energization deterioration of these means in some cases although the degree of deterioration is slight.

As described above, the toner charging means 7 and the electrostatic latent image erase means 8 are not limited to the fixed brush-shaped member but may be any shaped members, such as a rotating brush member, an elastic roller and a sheet-shaped member.

In this embodiment, depending on the timings of the voltage application integration time, a period of time in which the applied DC voltage is not increased and a period of time in which an increment of the applied DC voltage is larger than that in Embodiment 1, are provided.

Figure 8:
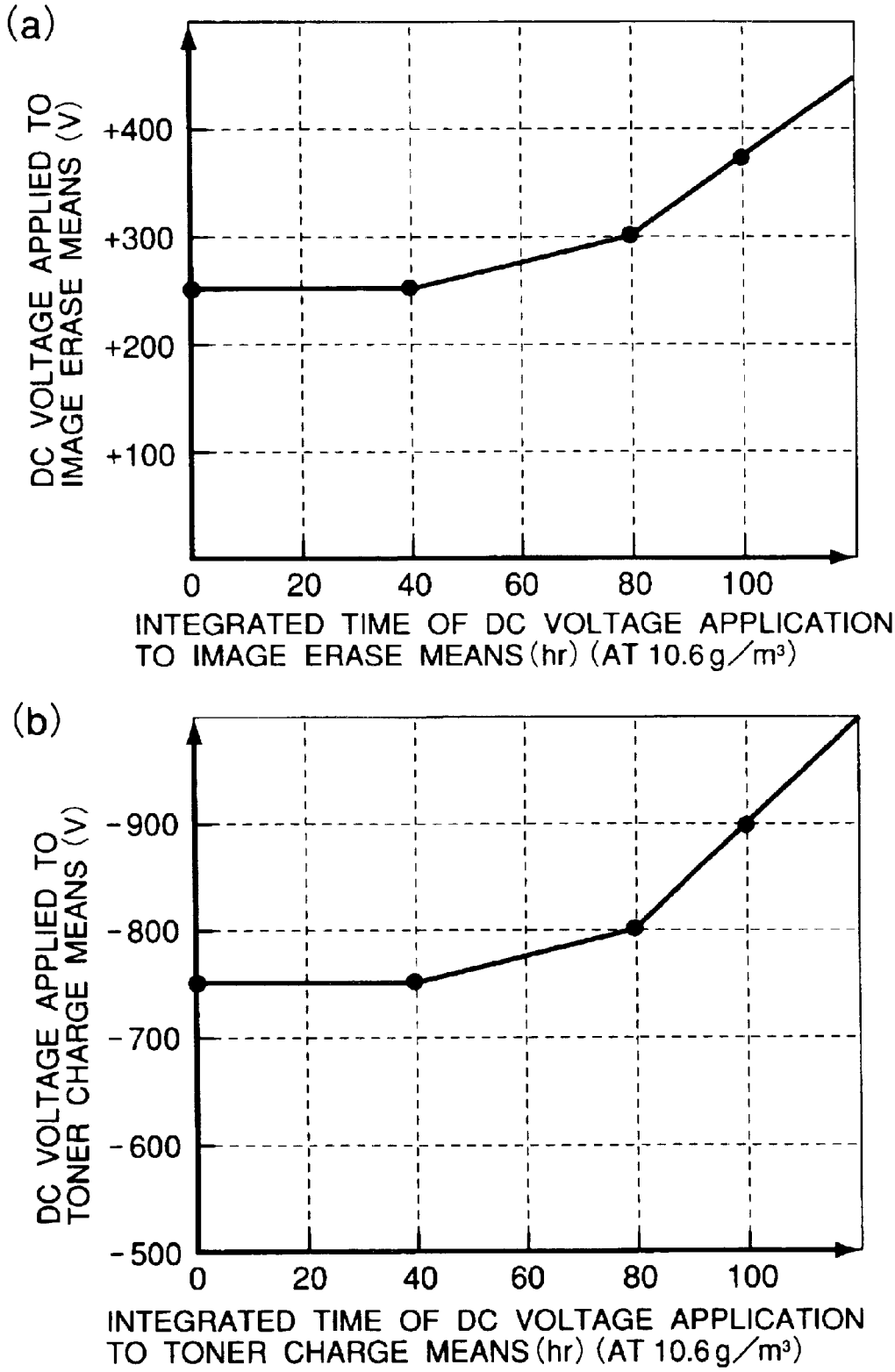
FIG. 8(*a*) is a graph showing a relationship between an integrated value of time of DC voltage application to and a control value of the DC voltage applied to the electrostatic latent image erase means 8, and FIG. 8(*b*) is a graph showing a relationship between the integrated value of time of DC voltage applied to and the control value of the DC voltage applied to the toner charging means 7, in another embodiment of the image forming apparatus.

More specifically, relationships between the voltage application integration time for the electrostatic latent image erase means 8 and the control value of DC voltage applied to the electrostatic latent image erase means 8 and between the voltage application integration time for the toner charging means 7 and the control value of DC voltage applied to the toner charging means 7, in the environment of the absolute humidity of 10.6 g/$m^3$ in this embodiment, are shown in FIGS. 8(*a*) and 8(*b*), respectively.

With respect to the electrostatic latent image erase means 8, as shown in FIG. 8(*a*), the control value (Vdc 1(t)) of DC voltage applied to the electrostatic latent image erase means 8 at a timing (t: voltage application integration time) is represented by the following equations (3), (4) and (5):

(i) voltage application integration time: 0 to 40 hours $$Vdc\ \mathbf{1}(t)=+250\ \text{V (constant)} \tag{3}$$

(ii) voltage application integration time: 40 to 80 hours $$Vdc\ \mathbf{1}(t)=Vdc\ \mathbf{1}(\mathbf{0})+50\times((t-40)/40) \tag{4}$$

(iii) voltage application integration time: not less than 80 hours $$Vdc\ \mathbf{1}(t)=(Vdc\ \mathbf{1}(\mathbf{0})+50)+75\times((t-80)/20) \tag{5}$$

In the above equations, Vdc 1(0) represents an initial control value of DC voltage applied to the electrostatic latent image erase means 8 at the initial stage and is determined on the basis of the absolute humidity value within the image forming apparatus, as shown in FIG. 8(*a*) (+250 V at the absolute humidity of 10.6 g/$m^3$).

With respect to the toner charging means 7, as shown in FIG. 8(*b*), the control value (Vdc 2(t)) of DC voltage applied to the toner charging means 7 at a timing (t: voltage application integration time) is represented by the following equations (6), (7) and (8):

(i) voltage application integration time: 0 to 40 hours $$Vdc\ \mathbf{2}(t)=-750\ \text{V (constant)} \tag{5}$$

(ii) voltage application integration time: 40 to 80 hours $$Vdc\ \mathbf{2}(t)=Vdc\ \mathbf{2}(\mathbf{0})+(-50)\times((t-40)/40) \tag{6}$$

(iii) voltage application integration time: not less than 80 hours $$Vdc\ \mathbf{2}(t)=(Vdc\ \mathbf{2}(\mathbf{0})-50)+(-100)\times((t-80)/20) \tag{7}$$

In the above equations, Vdc 2(0) represents an initial control value of DC voltage applied to the toner charging means 7 at the initial stage and is determined on the basis of the absolute humidity value within the image forming apparatus, as shown in FIG. 8(*b*) (−750 V at the absolute humidity of 10.6 g/$m^3$).

As described above, according to this (second) embodiment, the control that the control values of DC voltages to be applied to the toner charging means 7 and the electrostatic latent image erase means 8 are increased stepwise on the basis of the voltage application integration time values for the toner charging means 7 and the electrostatic latent image erase means 8 is performed, whereby the same effect as in Embodiment 1 can be achieved while suppressing the deterioration of the toner charging means 7 and the electrostatic latent image erase means 8 due to continuous energization at less as possible.

<Embodiment 3>

Next, a third embodiment of the present invention will be described.

In this embodiment, the general structure of an image forming apparatus (laser beam printer) is similar to that of the image forming apparatus used in Embodiment 1. Accordingly, respective members having the same function and structure identical to those of the printer 100 used in Embodiment 1 are represented by identical reference numerals or symbols and detailed explanations therefor are omitted.

In Embodiment 1, the control such that the control values of DC voltages to be applied to the toner charging means 7 and the electrostatic latent image erase means 8 were continuously increased linearly in accordance with the integrated time values of voltage application to the toner charging means 7 and the electrostatic latent image erase means 8 as the amount of operation of the image forming apparatus was always performed by the control means 10 irrespective of the environmental conditions of the image forming apparatus used (FIGS. 6(*b*) and 7(*b*)).

However, the characteristics of the toner subjected to the development by the developing apparatus 4 and the transfer residual toner are somewhat different depending on the environment of the image forming apparatus used.

Figure 11:
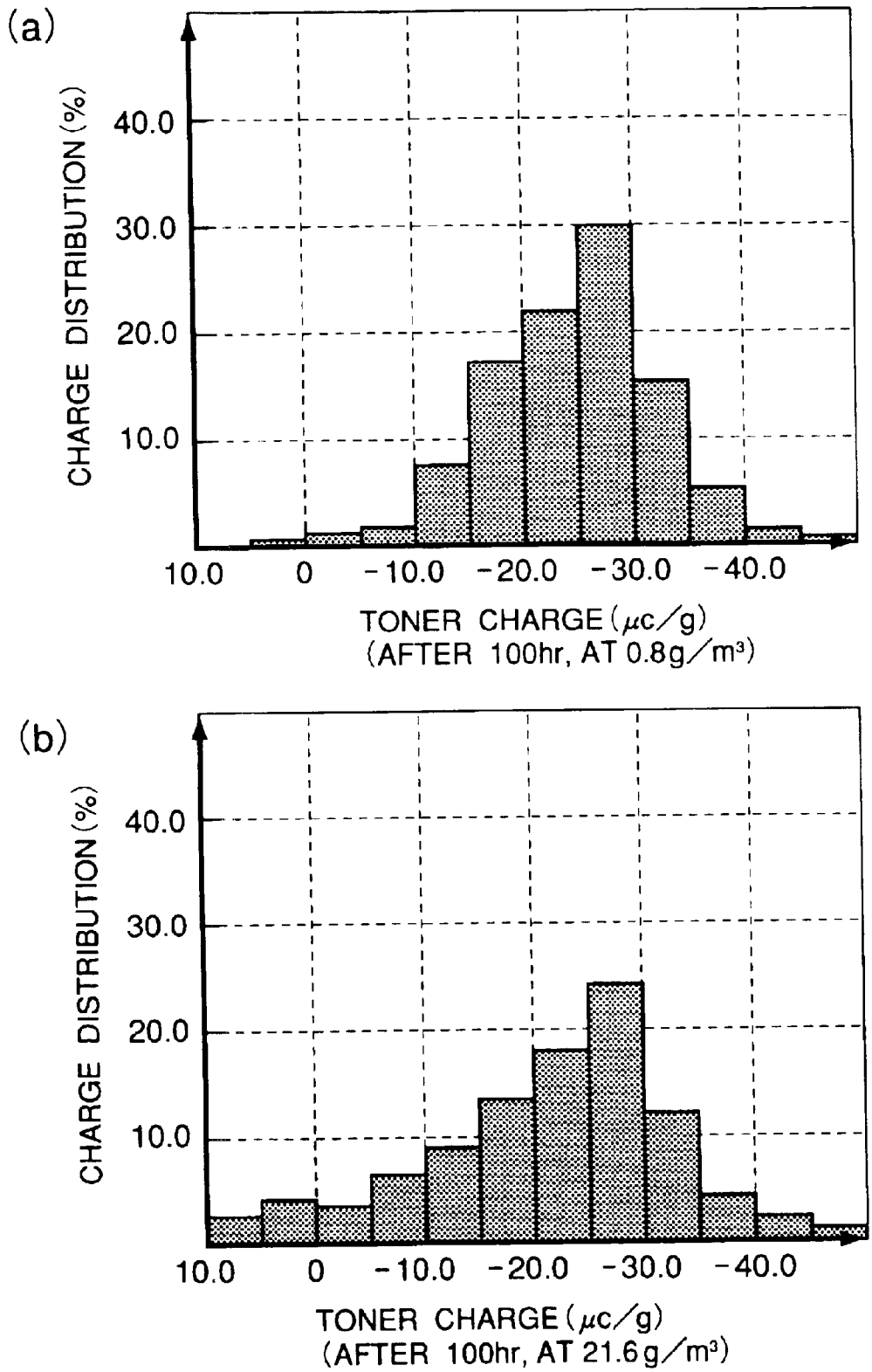
FIG. 11(*a*) is a graph showing a distribution of the amount of charge of the toner developed by the developing means after the image forming apparatus is used for a long period of time in a low-humidity condition, and FIG. 11(*b*) is a graph showing a distribution of the amount of charge of the toner developed by the developing mean after the image forming apparatus is used for a long period of time in a high-humidity environment.

More specifically, in the low humidity environment (absolute humidity: 0.8 g/m$^3$), the charge amount distribution of the developing toner subjected to the development by the developing apparatus 4 after continuous energization for 100 hours (FIG. 11(*a*)) is substantially similar to the initial charge amount distribution in the environment of the absolute humidity of 10.6 g/m$^3$ (FIG. 10(*a*)). On the other hand, in the high humidity environment (absolute humidity: 21.6 g/m$^3$), the charge amount distribution after continuous energization for 100 hours (FIG. 11(*b*)) becomes broad and includes an increased amount of toner particles inverted in charge polarity.

Accordingly, in Embodiment 1, there is a possibility of occurrences of the adhesion of the transfer residual toner to the charge roller 2 and the recovery failure of the transfer residual toner into the developing apparatus because the increment of the DC voltage control value relative to the voltage application integration time values is always constant irrespective of the environmental conditions of the image forming apparatus used, so that the DC voltages applied to the toner charging means 7 and the electrostatic latent image erase means 8 are liable to become insufficient to fail to perform the appropriate control of the transfer residual toner.

Figure 12:
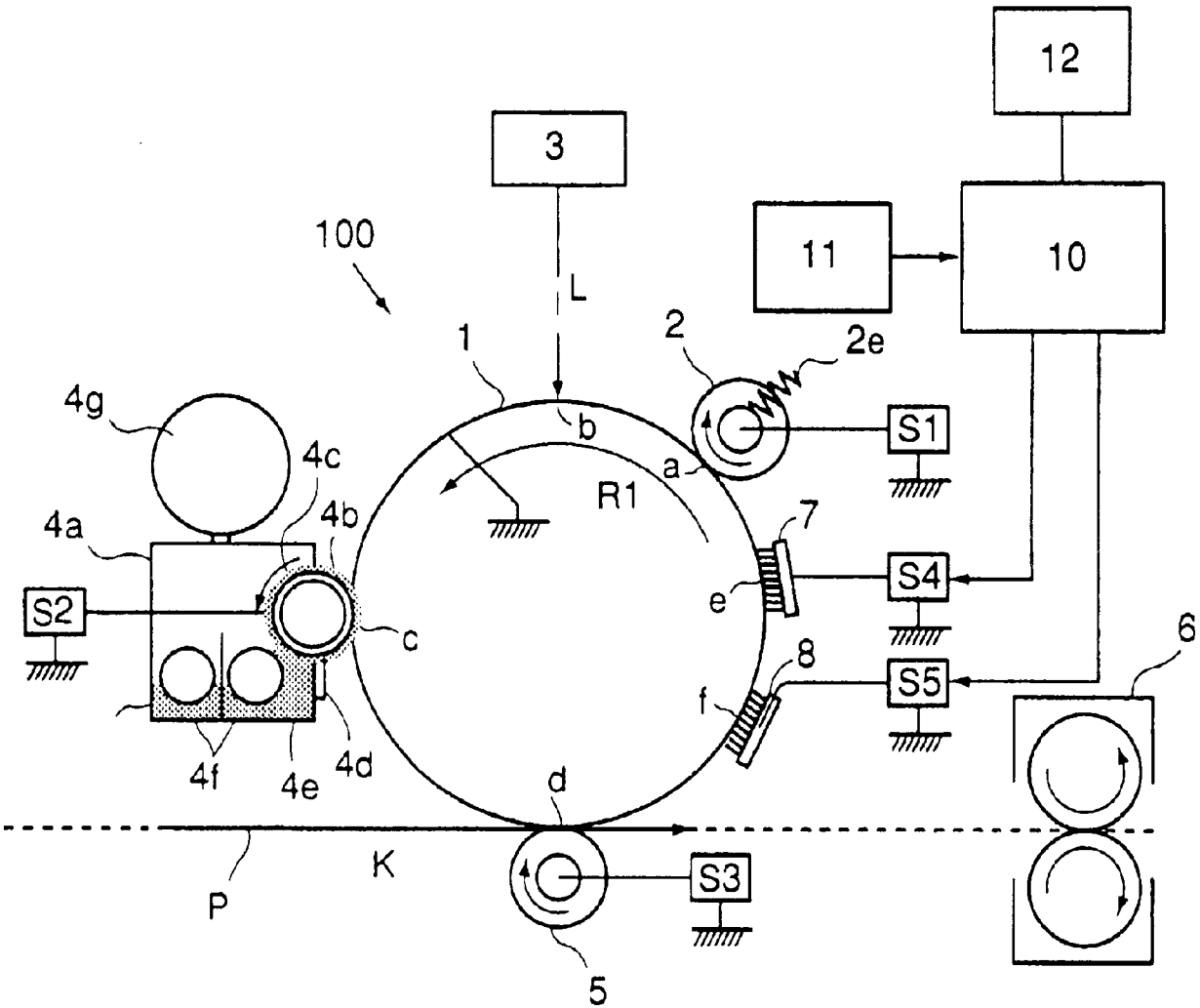
FIG. 12 is a schematic sectional view of another embodiment of the image forming apparatus of the present invention, for illustrating the general structure thereof.

Accordingly, in this (third) embodiment, an environmental sensor 12 for detecting ambient temperature and humidity is disposed within the image forming apparatus as shown in FIG. 12. On the basis of absolute humidity values calculated from the detected values, the increment of the DC voltage control values relative to the voltage application integration time values is changed.

Figure 9:
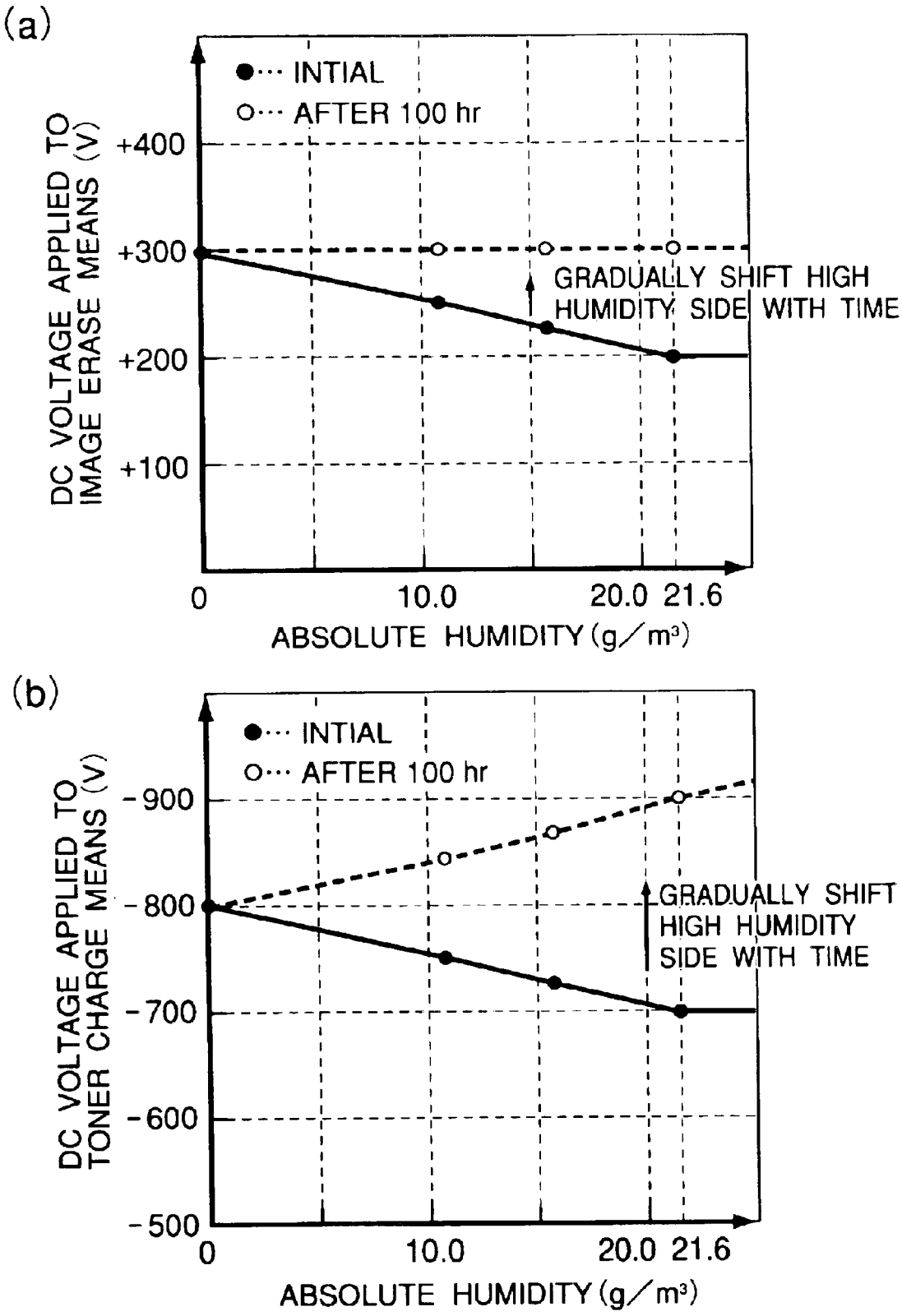
FIG. 9(*a*) is a graph showing a relationship between the absolute humidity and the control value of the DC voltage applied to the electrostatic latent image erase means 8, and FIG. 9(*b*) is a graph showing a relationship between the absolute humidity and the control value of the DC voltage applied to the toner charging means 7, in still another embodiment of the image forming apparatus.

In this embodiment, relationships between the absolute humidity and the control value of DC voltage applied to the electrostatic latent image erase means 8 and between the absolute humidity and the control value of DC voltage applied to the toner charging means 7, at the initial stage and after continuous energization for 100 hours ar shown in FIGS. 9(*a*) and 9(*b*), respectively.

Referring to FIG. 9(*a*), the control value of DC voltage applied to the electrostatic latent image erase means 8 is appropriately increased at respective absolute humidities as follows:

(i) absolute humidity: 0.8 g/m$^3$
  +300 V (initial and after 100 hours) (not changed)
(ii) absolute humidity: 10.6 g/m$^3$
  +250 V (initial) to +300 V (after 100 hours) (increment: +50 V)
(iii) absolute humidity: 21.6 g/m$^3$
  +200 V (initial) to +300 V (after 100 hours) (increment: +100 V)

The manner of increment may be performed in the same manner as in Embodiment 1 or 2.

Similarly, referring to FIG. 9(*b*), the control value of DC voltage applied to the toner charging means 7 is appropriately increased at respective absolute humidities as follows:

(i) absolute humidity: 0.8 g/m$^3$
  −800 V (initial and after 100 hours) (not changed)
(ii) absolute humidity: 10.6 g/m$^3$
  −700 V (initial) to −800 V (after 100 hours) (increment: 100 V as an absolute value)
(iii) absolute humidity: 21.6 g/m$^3$
  −700 V (initial) to −900 V (after 100 hours) (increment: 200 V as an absolute value V)

The manner of increment may be performed in the same manner as in Embodiment 1 or 2.

As described above, according to this embodiment, in the case where the control values of DC voltages applied to the toner charging means 7 and the electrostatic latent image erase means 8 are increased on the basis of the voltage application integration times for the toner charging means 7 and the electrostatic latent image erase means 8, the increments of DC voltages applied to the toner charging means 7 and the electrostatic latent image erase means 8 are changed depending on the operating environmental conditions of the image forming apparatus (specifically, the absolute humidity values), whereby the similar effect as in Embodiment 1 can be attained irrespective of the operating environmental conditions of the image forming apparatus.

(Others)

1) In the preceding embodiments, the amount ($\mu$C/g) of the electric charge of toner was measured using the so-called blow-off method.

2) The choice of the exposing means 3 as an information writing means does not need to be limited t the laser beam scanner in the preceding embodiments. It may be one of the digital exposing apparatuses other than the laser beam scanner. For example, it may be an LED array, a combination of a light source, such as a fluorescent lamp, and a liquid crystal shutter, or the like. Also, it may be an analog exposing apparatus which focally projects the image of an original onto an image bearing member.

3) The image bearing member 1 may be an electrostatically recordable dielectric member. In such a case, the surface of the dielectric member is uniformly charged to predetermined polarity and potential level, and then, an electrostatic latent image is written thereon by selectively removing the electric charge, in the pattern reflecting the image formation information, with the use of a charge removing means (information writing means), for example, a charge removal needle array, an electron gun, etc.

4) The transfer material P as the image receiving member may be an intermediary transfer member such as an intermediary transfer drum, an intermediary transfer belt, etc. In such a case, a toner image is transferred twice; first, from an image bearing member onto an intermediary transfer member, an then, from the intermediary transfer member onto the transfer material, such as a sheet.

5) The waveform of the AC voltage of the bias voltage applied to the contact charging apparatus 2 or developing apparatus 4 may be optional; it may be sinusoidal, rectangular, triangular, or the like. The AC bias voltage includes voltage with such a rectangular waveform that is formed by periodically turning on and off a DC power supply.

What is claimed is:

1. An image forming apparatus, comprising:

an image bearing member to be moved rotationally, charging means for electrically charging said image bearing member and toner remaining on said image bearing member, electrostatic latent image forming means for forming an electrostatic latent image on said image bearing member charged by said charging means, developing means for visualizing the electrostatic latent image while recovering the toner remaining on said image bearing member, toner charging means which is disposed upstream from said charging means in a rotational direction of said image bearing member and is to be supplied with a voltage of a polarity identical to that of a voltage to be applied to said charging means to electrically charge the toner remaining on said image bearing member, recording means for recording data regarding an operation history of said image forming apparatus, and voltage switching means for switching a first voltage applied to said toner charging means to a second voltage, higher than the first voltage, as an absolute value, applied to said toner charging means on the basis of the data.

2. An apparatus according to claim 1, wherein said charging means contacts said image bearing member.

3. An apparatus according to claim 1 or 2, wherein said image forming apparatus further comprises an electrostatic latent image erase means which is disposed upstream from said charging means toner in the rotational direction of said image bearing member and is to be supplied with a voltage of a polarity opposite from that of the voltage to be applied to said charging means to erase an electrostatic latent image on said image bearing member, and said control means controls the voltages to be supplied to said toner charging means and said electrostatic latent image erase means on the basis of the operation history of said image forming apparatus recorded by said recording means.

4. An apparatus according to claim 3, wherein said charging means is supplied with a DC voltage which is lower than that supplied to said toner charging means in terms of an absolute value.

5. An apparatus according to claim 4, wherein the rotational direction of said image bearing member at its surface is the same as that of a developer bearing member for bearing the magnetic brush.

6. An apparatus according to claim 3, wherein said charging means is supplied with a DC voltage and comprises a brush-shaped member.

7. An apparatus according to claim 6, wherein the rotational direction of said image bearing member at its surface is the same as that of a developer bearing member for bearing the magnetic brush.

8. An apparatus according to claim 3, wherein said developing means comprises at least a magnetic brush comprising a magnetic carrier and toner, said magnetic brush contacting said image bearing member.

9. An apparatus according to claim 8, wherein the rotational direction of said image bearing member at its surface is the same as that of a developer bearing member for bearing the magnetic brush.

10. An apparatus according to any one of claims 1 or 2, wherein said charging means is supplied with a DC voltage which is lower than that supplied to said toner charging means in terms of an absolute value.

11. An apparatus according to claim 10, wherein said charging means is supplied with a DC voltage and comprises a brush-shaped member.

12. An apparatus according to claim 11, wherein the rotational direction of said image bearing member at its surface is the same as that of a developer bearing member for bearing the magnetic brush.

13. An apparatus according to claim 10, wherein said developing means comprises at least a magnetic brush comprising a magnetic carrier and toner, said magnetic brush contacting said image bearing member.

14. An apparatus according to claim 13, wherein the rotational direction of said image bearing member at its surface is the same as that of a developer bearing member for bearing the magnetic brush.

15. An apparatus according to any one of claims 1 or 2, wherein said charging means is supplied with a DC voltage and comprises a brush-shaped member.

16. An apparatus according to claim 15, wherein said developing means comprises at least a magnetic brush comprising a magnetic carrier and toner, said magnetic brush contacting said image bearing member.

17. An apparatus according to claim 16, wherein the rotational direction of said image bearing member at its surface is the same as that of a developer bearing member for bearing the magnetic brush.

18. An apparatus according to any one of claims 1 or 2, wherein said developing means comprises at least a magnetic brush comprising a magnetic carrier and toner, said magnetic brush contacting said image bearing member.

19. An apparatus according to claim 18, wherein the rotational direction of said image bearing member at its surface is the same as that of a developer bearing member for bearing the magnetic brush.

* * * * *

UNITED STATES PATENT AND TRADEMARK OFFICE

CERTIFICATE OF CORRECTION

PATENT NO. : 6,952,546 B2
DATED : October 4, 2005
INVENTOR(S) : Tadanobu Yoshikawa It is certified that error appears in the above-identified patent and that said Letters Patent is hereby corrected as shown below:

Drawings,
Sheet 3, Figure 3, “CHAGES” should read -- CHARGERS --.

Column 2,
Line 23, “lower” should read -- lowers --.

Column 4,
Line 9, “mean” should read -- means --; and
Line 65, “for, preventing” should read -- for preventing --.

Column 5,
Line 3, “uniformize” should read -- uniformizes --; and
Line 45, “pot” should read -- not --.

Column 7,
Line 4, “r” should be deleted; and
Line 50, “o” should read -- of --.

Column 10,
Line 13, “becomes” should read -- become --.

Column 11,
Line 25, “its” should read -- it --.

Column 12,
Line 21, “charge-removing” should read -- charge-remove --; and
Line 27, “charge-treating” should read -- charge-treat --.

Column 15,
Line 42, “a also” should read -- as also --.

Column 16,
Line 13, “However,” should read -- However, if --.

Column 17,
Line 14, “resistivity o” should read -- resistivity of --.

Column 18,
Line 54, “at less” should read -- as little --.

UNITED STATES PATENT AND TRADEMARK OFFICE

CERTIFICATE OF CORRECTION

PATENT NO. : 6,952,546 B2
DATED : October 4, 2005
INVENTOR(S) : Tadanobu Yoshikawa It is certified that error appears in the above-identified patent and that said Letters Patent is hereby corrected as shown below:

Column 19,
Line 48, “ar” should read -- are --.

Column 20,
Line 27, “limited t” should read -- limited to --; and
Line 49, “an then,” should read -- and then, --.

Column 21,
Line 22, “charging means toner” should read -- toner charging means --.

Signed and Sealed this

Twenty-first Day of March, 2006

JON W. DUDAS
*Director of the United States Patent and Trademark Office*